US006151051A

United States Patent [19]

Ikeda et al.

[11] Patent Number: 6,151,051

[45] **Date of Patent: *Nov. 21, 2000**

[54] DETACHABLE INK JET UNIT AND INK JET APPARATUS

[75] Inventors: Masami Ikeda; Naohito Asai, both of Yokohama; Tsuyoshi Orikasa, Kasukabe; Tsutomu Abe, Isehara; Seiichiro Karita, Yokohama; Eiichiro Shimizu, Urawa; Masahiko Higuma, Togane, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/665,351

[22] Filed: Jun. 17, 1996

Related U.S. Application Data

[63] Continuation of application No. 08/169,404, Dec. 20, 1993, abandoned.

[30] Foreign Application Priority Data

Dec. 25, 1992 [JP] Japan ..... 4-345671

[51] Int. Cl.[7] ..... B41J 2/175

[52] U.S. Cl. ..... 347/86; 347/50

[58] Field of Search ..... 347/49, 50, 85, 347/86, 87

[56] References Cited

U.S. PATENT DOCUMENTS

| | | | |
|---|---|---|---|
| 3,960,255 | 6/1976 | Bisson et al. | 400/120.16 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,635,080 | 1/1987 | Watanabe | 347/50 |
| 4,684,962 | 8/1987 | Hirosawa et al. | 347/85 |
| 4,723,129 | 2/1988 | Endo et al. | 347/56 |
| 4,740,796 | 4/1988 | Endo et al. | 347/56 |
| 4,847,631 | 7/1989 | Naruse et al. | 347/49 |
| 4,940,413 | 7/1990 | Childers et al. | 347/50 |
| 5,138,342 | 8/1992 | Kurata et al. | 347/50 |
| 5,162,818 | 11/1992 | Karita et al. | 347/50 |
| 5,552,812 | 9/1996 | Ebinuma et al. | 347/34 |

FOREIGN PATENT DOCUMENTS

| | | |
|---|---|---|
| 0 379 151 | 7/1990 | European Pat. Off. . |
| 0 443 722 | 8/1991 | European Pat. Off. . |
| 0 496 620 | 7/1992 | European Pat. Off. . |
| 0 514 153 | 11/1992 | European Pat. Off. . |
| 59-123670 | 7/1984 | Japan . |
| 59-138461 | 8/1984 | Japan . |
| 60-204342 | 10/1985 | Japan . |
| 60-204343 | 10/1985 | Japan . |
| 63-004953 | 1/1988 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet head for ejecting ink, has an ink ejecting portion having an ink ejecting port formed thereon so as to eject ink through the ink ejecting port, a positioning portion for definitely determining the position of the ink jet head relative to an apparatus using the ink jet head when the ink jet head is fitted to the apparatus, an ink supplying portion adapted to be connected an ink supplying unit while ink is supplied to the ink jet head, and an electric connecting portion adapted to be electrically connected to an electric connecting portion on the apparatus side so as to send and receive signals. The positioning portion, the ink supplying portion and the electric connecting portion are disposed on a different surface from a surface on which the ink ejecting portion is disposed and at least one of the electric portion and the ink supplying portion is disposed on an opposite side surface to a surface on which the positioning portion is disposed.

33 Claims, 13 Drawing Sheets

DETACHABLE INK JET UNIT AND INK JET APPARATUS

This application is a continuation of application Ser. No. 08/169,404 filed Dec. 20, 1993, now abandoned.

BACKGROUND OF THE INVENTION

1. Field of the Invention

The present invention relates to an ink jet apparatus, and more particularly, to an ink jet recording apparatus employable for a printer, a facsimile, a copying machine or the like.

In a description below, a term. "recording" is used as a word which also includes "printing" of an image or the like on a paper, a texture or the like.

2. Description of the Related Art

In contrast with other types of printing systems, an ink jet printing system has advantages that a small-sized printing apparatus having a light weight can easily be realized on the actual machine basis, it generates little noise, and moreover, a printing operation can be performed with the apparatus using plain papers. For this reason, in recent years, most of low cost printers are designed and constructed to operate in accordance with a principle of the ink jet printing system. With a bubble jet printing system, i.e., one type of the ink jet printing system, a number of ink ejecting ports formed on an ink jet head can easily be arranged at a high density, and an ink jet printing apparatus having the bubble jet printing system employed therefor consumes a small quantity of electricity during each printing operation. In view of the foregoing fact, many printers each having the bubble jet printing system employed therefor are shipped to a commercial market.

At present, the ink jet printing system is classified into two types depending on a manner of supplying ink.

A first type of them is such that an ink jet head is mounted on a carriage, and a large volume ink tank is arranged at a predetermined position on the apparatus side so that ink is supplied to an ink jet head via an ink tube.

In the case that the above-mentioned type ink jet printing system is employed, each printing operation can be achieved at a very low running cost. However, since it is required that the running life of an ink jet head is substantially equal to or longer than that of an ink jet printing apparatus having the ink jet head mounted thereon, the structure of the ink jet head, associated component and materials employed therefor should be improved, resulting in a cost of the ink jet printing apparatus being unavoidably increased.

Secondly, there is known an ink jet printing system in which an ink jet unit consisting of an ink tank and an ink jet head is detachably mounted on a carriage.

In the case that the second-mentioned type ink jet printing system is employed, small extension of the ink tube is required, and an ink tank replacing operation can easily be achieved, and moreover, an ink jet printing apparatus having this ink jet printing system employed therefor can be constructed with small dimensions. However, when ink contained in the ink tank is consumed, the empty ink tank is replaced with a new one together with an ink jet head, resulting in a running cost of the ink jet printing apparatus being likewise increased. Especially, since the ink jet head having a running life at least until the ink contained in the ink tank is completely consumed should uselessly be wasted, the foregoing ink jet printing system is not acceptable from the viewpoint of ecology or a similar factor.

To eliminate the problems inherent to the last-mentioned type ink jet printing system, a proposal has been made with respect to an ink jet printing apparatus wherein an ink jet head and an ink tank are separately arranged and they are detachably mounted on a carriage as disclosed in Japanese Patent Application Laying-Open No. 4953/1988. The proposed ink jet printing apparatus has an advantage that the problem of an increased cost of the ink jet printing apparatus can be solved because the ink jet head and the ink tank can independently be replaced with new ones.

In the case that the ink jet unit is detachably mounted on the carriage, it is required that correct locating of the ink jet unit (the ink jet head and the ink tank) on the carriage and electrical connection between the ink jet unit and the main body side of the ink jet printing apparatus for transmitting signals to the former from the latter are taken into account. To satisfactorily meet the requirement, proposals have been made with respect to an improved ink jet printing apparatus as disclosed in Japanese Patent Application Laying-open Nos. 204342/1985 and 204343/1985. According to each of the prior arts, a plurality of electrical contacts for making electrical connection between an ink jet head and the main body side of an ink jet printing apparatus are arranged on the upper surface of the ink jet head located above an ink ejecting port, and moreover, other electrical contacts of the main body side of the ink jet printing apparatus are arranged on the carriage corresponding to the first-mentioned electrical contacts. To assure that the ink jet unit is correctly mounted at a predetermined position on the carriage, the ink jet printing apparatus is additionally provided with an engagement member.

With the ink jet printing apparatus constructed according to each of the prior art systems, however, since the ink jet unit is made of the ink jet head being integrated with an ink tank, the arrangement of the electrical contacts in the above-described manner is not necessarily acceptable in the case that modification is made so as to enable the ink tank to be separated from the ink jet head. In other words, in the ink jet unit with a structure such that the ink jet head and the ink tank are detachable from each other, on the ink jet head, there are disposed not only electrical contacts and a position determining member but also an ink supply portion for receiving ink from the ink tank. Therefore, the number of pieces of equipment to be provided for the ink jet head is increased. In addition, the arrangement of these pieces of equipment should be determined in consideration of an attaching/detaching operation to be performed when the ink tank is attached to and detached from the ink jet head and the connection structure of an ink path for supplying ink to the ink jet head. As a result, in the structure such that the attachment and detachment of the ink jet unit is performed relative to the carriage and such that the ink jet head and the ink tank which form the ink jet unit are detachable from each other, it has been requested that the following items are taken into account when the ink jet head and the ink jet unit are designed and constructed.

1) To prevent electrical reliability of the ink jet head from being deteriorated due to adhesive deposition of ink and paper particles on the ink jet head.
2) To improve a positional accuracy of the ink jet head when the ink jet head and the ink tank are mounted on the carriage.
3) To assure that the empty ink tank is easily replaced with a new one after the ink contained in it is consumed.
4) To improve an accuracy of positional relation among plurality of ink jet heads when a color printing operation is performed using the plurality of ink jet heads.
5) To easily produce ink jet heads, ink tanks and associated components.

SUMMARY OF THE INVENTION

The present invention has been made in consideration of the aforementioned background.

An object of the present invention is to provide an ink jet head, an ink jet unit and an ink jet apparatus which can be produced at an inexpensive cost with small dimensions and which assures that a high quality of image can be printed on a sheet of paper with high reliability and high operability.

Another object of the present invention is to provide an ink jet head, an ink jet unit and an ink jet apparatus with which an ink tank can be attached to and detached from the ink jet head mounted on the ink jet apparatus with high operability.

A further object of the present invention is to provide an ink jet head, ink jet unit and an ink jet apparatus which can practically be used at a low running cost and which are employable especially for a colored ink ejecting type printing apparatus.

A further object of the present invention is to provide an ink jet head, and an ink jet unit which assure that an ink ejecting portion is disposed on a portion of the ink jet head which portion differs from a portion on which an ink supply portion or an electric connecting portion is disposed so that reliability of the ink jet unit is increased without any interference with the ink supplying portion and the electric connecting portion but also without any deterioration of a function of each of the ink supplying portion and the electric connecting portion.

In the first aspect of the present invention, there is provided an ink jet head for ejecting ink, comprising:

an ink ejecting portion having an ink ejecting port formed thereon so as to eject ink through the ink ejecting port;

a positioning portion for definitely determining the position of the ink jet head relative to an apparatus using the ink jet head when the ink jet head is fitted to the apparatus;

an ink supplying portion adapted to be connected to ink supplying means while ink is supplied to the ink jet head; and an electric connecting portion adapted to be electrically connected to an electric connecting portion on the apparatus side so as to send and receive signals;

wherein the positioning portion, the ink supplying portion and the electric connecting portion are disposed on a different surface from a surface on which the ink ejecting portion and at least one of the electric portion and the ink supplying portion is disposed on an opposite side surface to a surface on which the positioning portion is disposed.

In the second aspect of the present invention, there is provided an ink jet unit comprising:

an ink ejecting portion having an ink ejecting port formed thereon so as to eject ink through the ink ejecting port;

a positioning portion for definitely determining the position of the ink jet head relative to an apparatus using the ink jet head when the ink jet head is fitted to the apparatus;

an ink supplying portion adapted to be connected to ink supplying means while ink is supplied to the ink jet head; and an electric connecting portion adapted to be electrically connected to an electric connecting portion on the apparatus side so as to send and receive signals;

the ink jet head including a plurality of outer surfaces which are individually assigned to the ink ejecting portion, the locating portion, the ink supplying portion and the electric connecting portion each of which is separately disposed on one of the outer surfaces, and an ink tank which is detachably connected to the ink jet head and which stores ink to be supplied to the ink jet head through the ink supplying portion.

In the third aspect of the present invention, there is provided an ink jet apparatus for ejecting ink to a medium so as to allow the ink to adhere to the medium, comprising:

an ink jet head comprising an ink ejecting portion having an ink ejecting port formed thereon so as to eject ink through the ink ejecting port;

a positioning portion for definitely determining the position of the ink jet head relative to an apparatus using the ink jet head when the ink jet head is fitted to the apparatus;

an ink supplying portion adapted to be connected to ink supplying means while ink is supplied to the ink jet head; and an electric connecting portion adapted to be electrically connected to an electric connecting portion on the apparatus side so as to send and receive signals;

wherein the positioning portion, the ink supplying portion and the electric connecting portion are disposed on a different surface from a surface on which the ink ejecting portion and at least one of the electric portion and the ink supplying portion is disposed on an opposite side surface to a surface on which the positioning portion is disposed and being adapted to be detachably fitted to the ink jet apparatus; and a carriage on which the ink jet head is detachably mounted and which is provided for moving.

The above and other objects, effects, features and advantages of the present invention will become more apparent from the following description of embodiments thereof taken in conjunction with the accompanying drawings.

BRIEF DESCRIPTION OF THE DRAWINGS

The present invention is illustrated in the following drawings in which.

DESCRIPTION OF THE PREFERRED EMBODIMENTS

Figure 1:
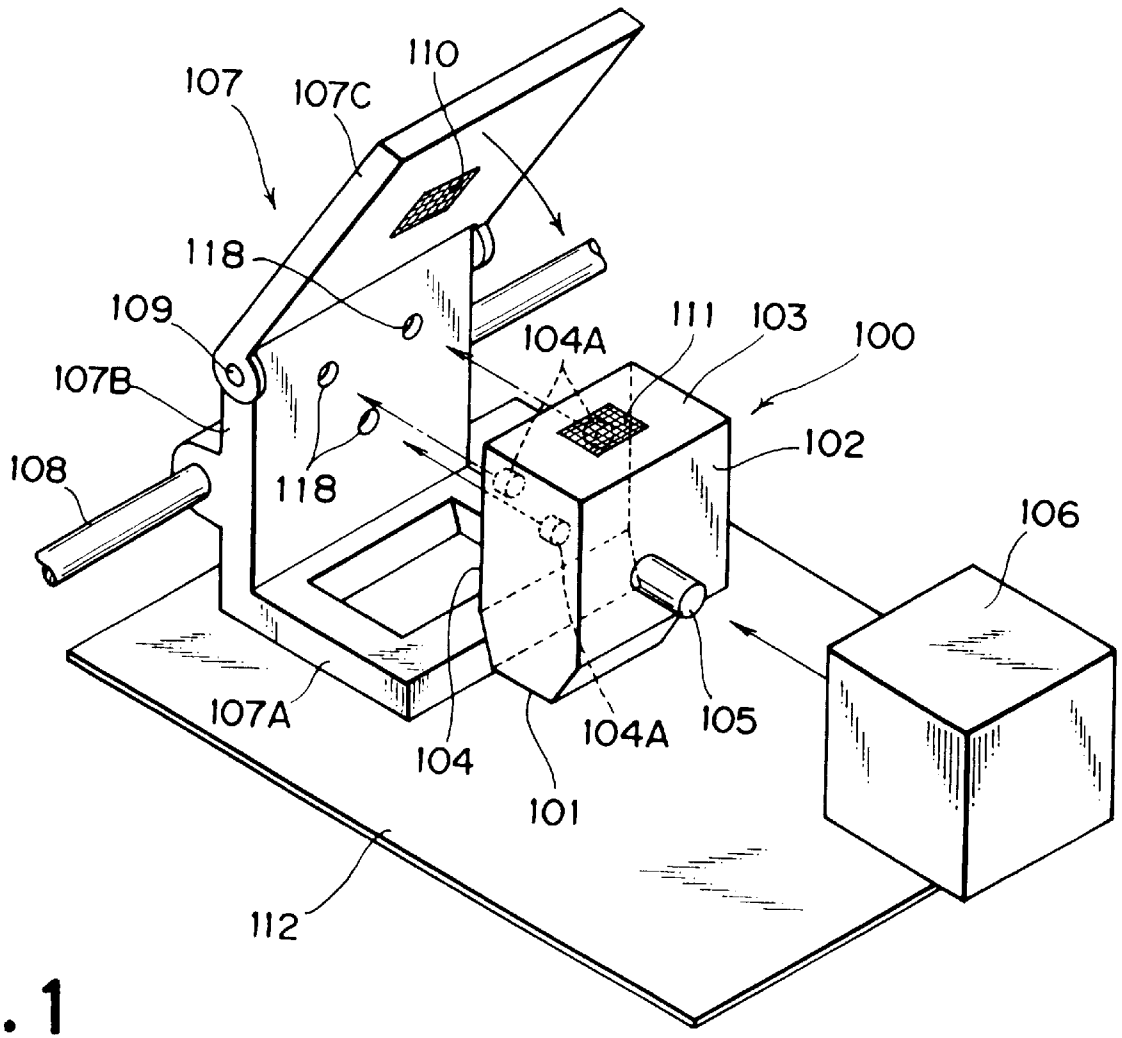
FIG. 1 is a perspective view showing the fundamental structure of the ink jet unit according to one embodiment of the present invention.

The present invention will be described in detail hereinafter with reference to the accompanying drawings which illustrate several preferred embodiments thereof.

To facilitate understanding of the present invention, the fundamental structure of an ink jet head (hereinafter also referred as a printing head) to which the present invention is applied will be described below prior to description of the preferred embodiments of the present invention.

According to the present invention, an ink jet unit includes an ink tank and an ink jet head both of which are detachably mounted on a carriage and both of which are detachable from each other, and the ink jet head includes the following main four functional portions on respective surfaces thereof.

(A) a portion for receiving a series of electric signals from the main body side of an ink jet apparatus (hereinafter referred to simply as an electric connecting portion), (B) a portion for receiving an ink from the ink tank (hereinafter referred to simply as an ink supplying portion), (C) a portion for ejecting the ink (hereinafter referred to simply as an ink ejecting portion), (D) a portion for correctly positioning the ink jet head relative to the carriage (hereinafter referred to simply as a positioning portion).

In connection with the practical construction of these four main functional portions, since high reliability of the ink jet head, a high quality of each image and easy replacement of each used ink jet head and each empty ink tank with new ones are highly required, it is desirable that the following structural conditions are taken into account when the ink jet head is designed and constructed.

(1) In the case that the ink supplying portion or the electric connecting portion is additionally arranged on the exact surface having the ink ejecting portion arranged thereon, there arises a necessity for enlarging the space for arranging these portions in the ink ejecting direction, causing the distance between the surface having the ink ejecting portion disposed thereon and the surface of a printing medium such as a sheet of printing paper or the like to be enlarged. Consequently, the deflection of ejected ink is increased, causing a quality of image to be unavoidably degraded.

(2) The ink tank is frequently replaced with another one compared with replacement of the ink jet head with another one, therefore, a force in an ink tank attaching/detaching direction is applied to the ink jet head during an attaching/detaching operation of the ink tank to/from the ink jet head. In the case that the ink jet head is displaced under the influence of the force appearing when the ink tank is attached to or detached from the ink jet head, the position of the ink jet head can not exactly be determined. For this reason, each ejected ink droplet ejected from the ink jet head can not exactly be shot to a predetermined position, resulting in a quality of image being degraded.

(3) Ink mist and paper particles are deposited on the ink ejecting portion of the ink jet head which confronts a printing medium, causing the ink jet head to be contaminated with them. For this reason, in the case that the positioning portion and the ink supplying portion of the ink jet head are additionally arranged on the surface on which the ink ejecting portion is disposed, there arise malfunctions that the ink ejecting position is dislocated from the original position, and moreover, a filter disposed at an ink supplying path is clogged with foreign material. Therefore, it is preferable that the positioning portion and the ink supply portion are arranged on another surface than the surface on which the ink ejecting portion is disposed. Especially, in the case that the electric connecting portion is additionally disposed on the ink ejecting portion, there occasionally arise malfunctions that incorrect electrical connection or short-circuit occurs due to the electrical conductivity of the ink induced by the deposition of the foreign material, and ink is incorrectly ejected or ejected ink droplets are erroneously shot to locations having no image signal transmitted thereto, resulting in incorrect dots being printed on the printing medium.

FIG. 1 shows an ink jet head, an ink tank and a structure for attaching them Lo a carriage of an embodiment of the present invention which take into account of the above-described conditions (1)–(3).

In FIG. 1, reference numeral 100 designates an ink jet head, and reference numerals 101, 102, 103 and 104 designate an ink ejecting portion, an ink supplying portion, an electric connecting portion and a positioning portion for positioning the ink jet head to a carriage of the main body of an apparatus, which are components of the ink jet head 100. Reference numeral 105 designates an ink supplying tube as an ink supplying member secured to the ink supplying portion 102 of the ink jet head 100, and reference numeral 106 designates an ink tank. When the ink tank 106 is fitted to the ink supplying portion 102 of the ink jet head 100 in the arrow-marked direction via the ink supplying tube 105, an ink supplying path built between the ink tank 106 and the ink supplying portion 102 is kept in the liquid tight state with the aid of a sealing member (not shown) interposed therebetween, whereby ink is supplied to the ink jet head 100 from the ink tank 106 without any occurrence of ink leakage.

Reference numeral 107 designates a carriage, which is a component of an ink jet apparatus, adapted to be slidably displaced along a guide shaft 108 by actuating a driving unit (not shown) while carrying the printing head 100 and the ink tank 106 thereon. In this embodiment, the carriage 107 is composed of a head supporting portion 107A for holding the ink ejecting portion 101 in the correctly located state on which an ink ejection port is disposed, a head fitting portion 107B having three locating holes 118 formed therethrough so as to allow three locating pins 104A to be inserted into the locating holes 118 when the locating portion 104 of the ink jet head 100 comes in contact with the front surface of the carriage 107, and a connector portion 107C turnably supported on the head fitting portion 107B via a hinge pin 109 while including a number of electrical contacts 110 on the inner surface thereof. Reference numeral 111 designates a number of electrical contacts constituting an electric connecting portion 103 of the ink jet head 100 to make electrical connection to the opponent electrical contacts 110 on the connector portion 107C. The connector portion 107C is turnably displaced in the arrow-marked direction so as to allow the front surface of the connector portion 107C including the electrical contacts 110 to come in contact with the electric connecting portion 103 while the ink jet head 100 is firmly supported by the carriage 107, so that the main body side of the ink jet apparatus can electrically be connected to the ink jet head 100 side. Incidentally, reference numeral 112 designates a printing medium in the form of a sheet of printing paper to be conveyed while facing to the ink ejecting portion 101 of the ink jet head 100.

Figure 2:
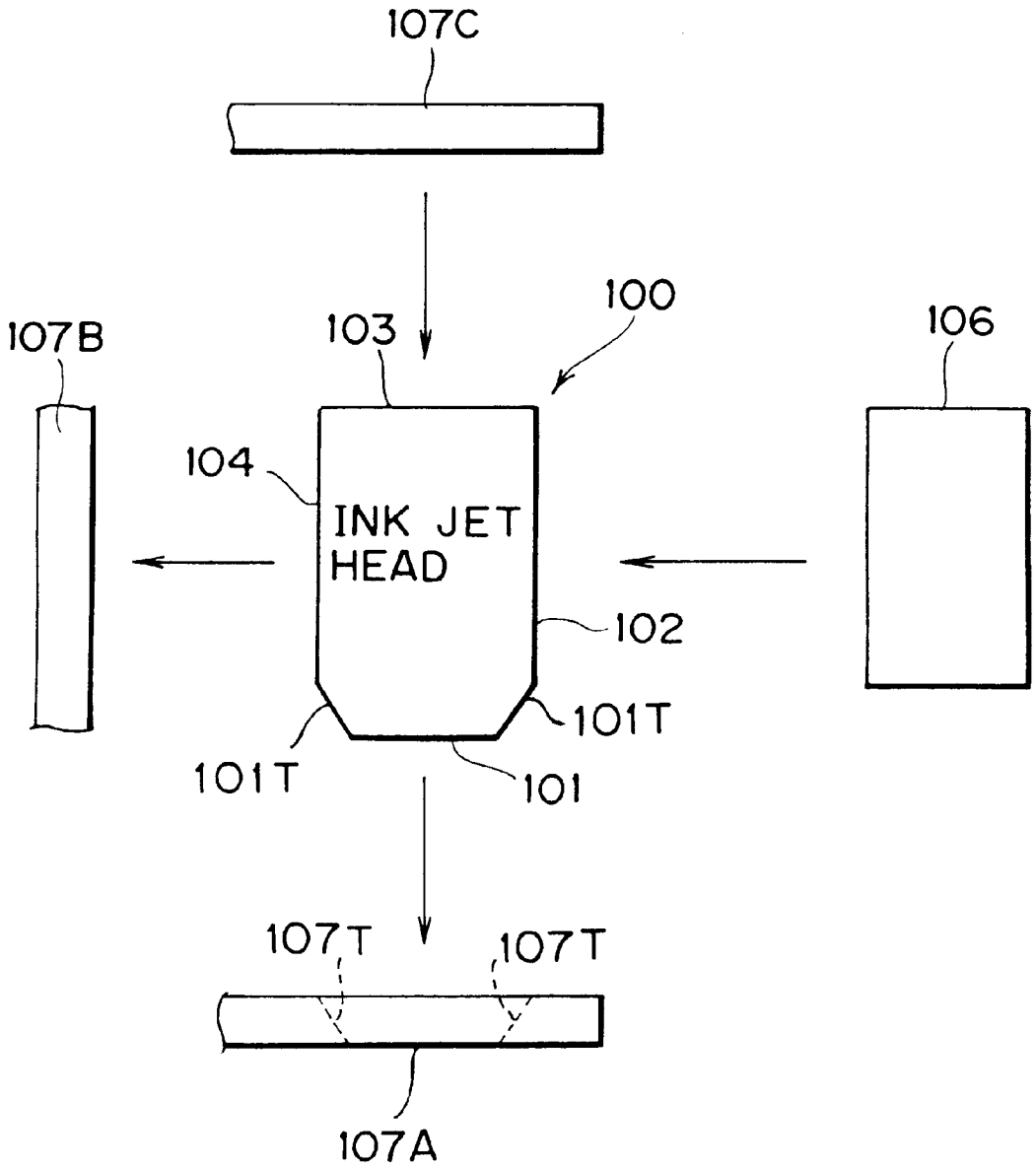
FIG. 2 is an illustrative view showing a connection relationship between outer components and the ink jet head shown in FIG. 1.

FIG. 2 schematically shows by way of illustrative view how the ink jet head 100 is connected to the ink tank 106, the head supporting portion 107A, the head fitting portion 107B, and the connector portion 107C of the cartridge 107 while each connected state is represented by an arrow-marked direction.

In this embodiment, the electric connecting, the ink supplying, the ink ejecting and the positioning portions of the ink jet head described above are arranged on the ink jet head so as to satisfy the following conditions.

The portions except the ink ejecting portion are arranged on different surfaces from the surface on which the ink ejecting portion is disposed. As a result, it is not necessary to enlarge a distance between the ink ejecting portion and the recording medium to the extent such that it is greater than the minimum distance need for ejecting ink to the recording medium so as to perform recording, so that an amount of deflection of an ejected ink from the ink jet head is not increased. In addition, according to the above-described structure, the electric connecting portion and the positioning portion are prevented from being affected by a splashing ink or the like, so that a fault in an electric connection produced by wetting of ink and a fault in a positioning does not occur.

In this embodiment, especially, the electric connecting portion, which is mostly affected by wetting of ink among the portions, is arranged on the opposite side surface to the surface on which the ink ejecting portion is arranged, and is arranged above the ink ejecting portion. Therefore, the above-described fault in the electric connection by wetting of ink is more effectively prevented. The positioning portion is also arranged above the ink ejecting portion so as to prevent positioning accuracy effectively from being decreased by wetting of ink or contamination.

In addition, wetting of ink arisen through the ink supplying portion is not as serious as that caused by the ink splash at the ink ejecting portion. However, according to the present embodiment, latter wetting of ink is effectively restricted because the ink supplying portion is arranged on the surface which is different from the surfaces on which the electric connecting portion and the positioning portion are arranged and especially the electric connecting portion is arranged above the ink supplying portion.

Furthermore, in this embodiment, the direction of allowing the ink tank 106 to be connected to the ink jet head 100 is coincident with the direction of allowing the three locating pins 104A on the ink jet head 100 (see FIG. 1) to be inserted into the opponent three locating pins 118 formed through the fitting portion 107B (see FIG. 1). That is, on the ink jet head 100, the positioning portion 104 is arranged on the opposite side surface to the surface on which the ink supplying portion 102 is arranged. According to a arrangement of the respective portions 101–104, when the ink tank 106 is attached to the ink jet head 100, a pressing force (designated by arrow C in FIG. 2) applied to the ink jet head 100 can be received by the positioning portion 104 and the fitting portion 107B of the carriage 107, so that the positioning of the ink jet head relative to the main body side of the ink jet apparatus is not affected by the force when the ink tank is attached to the ink jet head.

In addition to the above-described arrangement of the respective portions 101–104, as shown in FIG. 2, the ink ejecting portion 101, the ink supplying portion 102, the electric connecting portion 103 and the locating portion 104 are individually arranged on four different side surfaces of the ink jet bead 100, whereby each of these portions 101, 102, 103 and 104 serves as a specific surface at an attaching operation of the ink tank so as to enable it to sufficiently exhibit its own function and to raise in operability.

In addition, there are formed a taper portions 101T as additional structure on the neighborhood of the ink ejecting portion, which portions engage with the carriage 107 in the main body of the ink jet apparatus. Therefore, the direction of allowing the ink tank 106 to be connected to the ink jet head 100 is oriented at a right angle relative to the direction of allowing of the ink jet head 100 to be connected to the head supporting portion 107A in the state that tapered portions 101T of the ink ejecting portion 101 are brought in contact with the opponent tapered surfaces 107T of the head supporting portion 107A. In addition, the direction of allowing the connector portion 107C to be connected to the electric connecting portion 103 is coincident with the direction of allowing the ink jet head 100 to be engaged with the head supporting portion 107A.

With such construction, when the force identified by an arrow mark C in FIG. 2 is applied to the ink jet head 100 at the time of replacing each empty ink tank 106 with a new one, there does not arise a malfunction that the ink jet head 100 is dislocated because the tapered surfaces 101T of the ink ejecting portion 101 are engaged with the opponent tapered surfaces 107T of the head supporting portion 107A. At this time, as described above, the head fitting portion 107B of the carriage 107 stands against the force identified by the C arrow mark in FIG. 2. Especially, when the connector portion 107C of the carriage 107 is turnably depressed against the ink jet head 100 with the downward orienting force, dislocation of the ink jet head 100 from the original position can reliably be prevented.

Furthermore, in this embodiment, since a connecting portion between the ink jet head 100 and the ink tank 106, at which portion attaching/detaching operation is performed most frequently, is disposed isolutedly from other portions on the ink jet head 100 and in the carriage 107, the operation for attaching/detaching of the ink tank 106 to/from the ink jet head 100 can be easily performed.

Next, an ink jet head and an ink jet unit constructed according to other embodiments of the present invention will be described below with reference to FIG. 3 to FIG. 7.

Figure 3A:
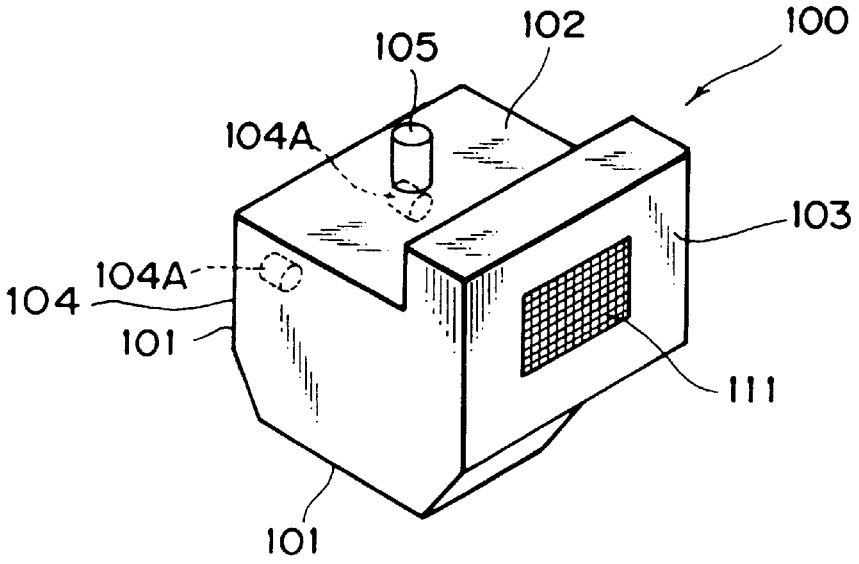
FIG. 3A is a perspective view of an ink jet head constructed according to a another embodiment of the present invention.
Figure 3B:
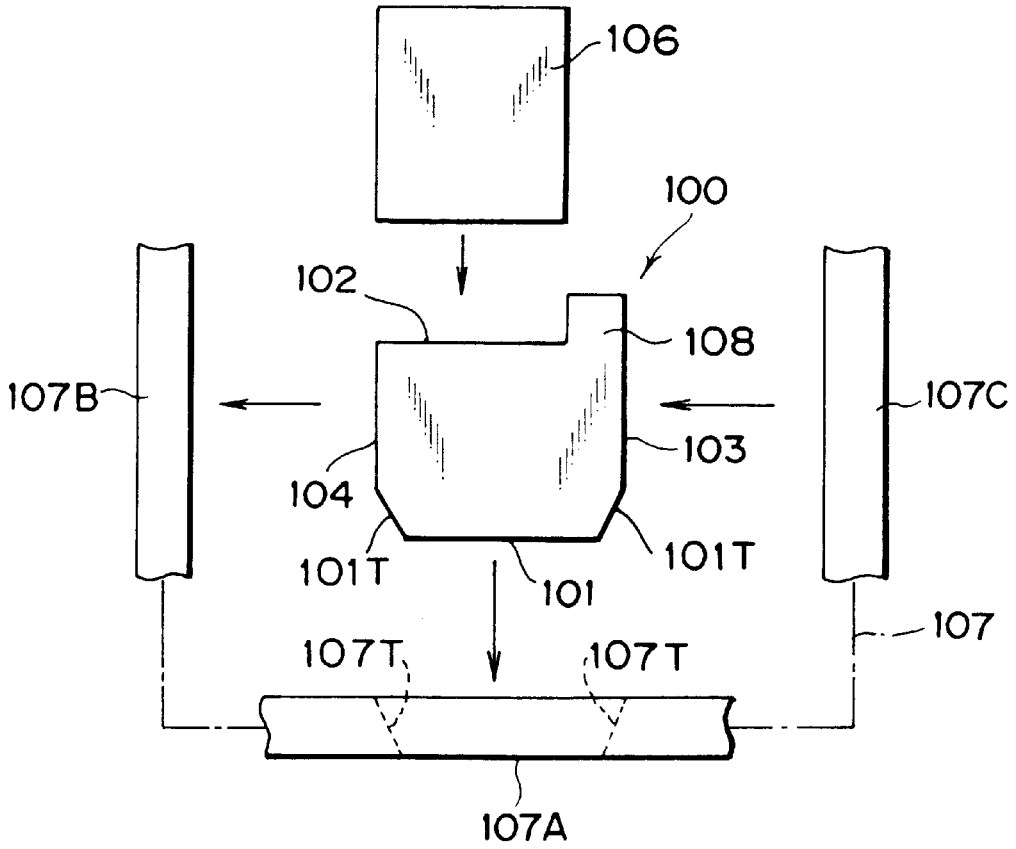
FIG. 3B is an illustrative view showing a connection relationship between outer components and the ink jet head shown in FIG. 3A.

FIG. 3A shows by way of perspective view the structure of an ink jet head 100 constructed according to a second embodiment of the present invention wherein an ink ejecting portion 101 on 10 which the ink ejection port is disposed and an ink supplying portion 102 are arranged on the upper and lower surfaces of the ink jet head 100, that is, opposite surfaces to each other, an electric connecting portion 103 is disposed on the front surface of the ink jet head 100 extending at a right angle relative to the ink ejecting portion 101 and the ink supplying portion 102, and the positioning portion 104 is disposed on the opposite side relative to the electric connecting portion 103. FIG. 3B shows by way of illustrative view of the structure of an ink jet unit inclusive of the ink jet head 100 wherein securing of the ink jet head 100 to the carriage 107, electrical connection to be made between electrical components, connecting relation of an ink tank 106, and connecting directions of respective portions are represented.

According to this embodiment, similar to the aforementioned embodiment, the electric connecting portion 103, the ink supply portion 102 and the positioning portion 104 are arranged at other surfaces, respectively from the surface of the ink jet head on which the ink ejecting portion 101 is arranged. Especially, the electric connecting portion 103 and the positioning portion 104 are disposed above the ink ejecting portion 101. With the above-described structure, there can be obtained the similar effect to the aforementioned embodiment which is caused by a positional relationship between the ink ejecting portion and other portions.

The structure of this embodiment especially aims at preventing the ink jet head from being dislocated by an attaching operation of the ink jet head to the ink jet apparatus. Therefore, the electric connecting portion 103 to be connected with the connector portion 107C of the carriage 107 is arranged, on the opposite side surface to the surface on which the positioning portion 104 is arranged, differently from the aforementioned embodiment. According to the above-described structure, the ink jet head 100 can be prevented from being dislocated by force applied during an electric connecting operation. The structure shown in FIG. 2 is suitable for such an ink jet apparatus that greater force is applied to the ink jet head when the ink tank is attached thereto than that applied when the electric connecting operation is performed. In the structure shown in FIGS. 3A and 3B, the reverse is true.

The ink ejecting portion 101, the ink supplying portion 102, the electric connecting portion 103 and the positioning portion 104 are also arranged on different surfaces from each other, so that similar effects to that of the aforementioned embodiment can be obtained. In addition, the taper portions 101T are formed at the neighborhood of the ink ejecting portion 101.

In this embodiment, attaching of the ink tank 106 to arid detaching the same from the ink jet head 100 are achieved in the same direction as that of allowing the ink jet head 100 to be engaged with a head supporting portion 107A. Dislocation of the ink jet head 100 from the original position which may occur at the attaching/detaching operation of the ink tank 106 can satisfactorily be prevented by fitting two locating pins 104 into the opponent locating holes 118 and bringing tapered portions 101T of the ink jet head 100 in engagement with the opponent tapered portions 107T of the head supporting portion 107A.

In view of positioned relationship between the ink supplying portion and other portions and of easiness of attaching/detaching operations of the ink tank to/from the ink jet head, the ink supplying portion is disposed above other portions. In this case, even if ink leaks from a connected portion between the ink jet head and the ink tank, the electric connecting portion 103 can be prevented from being affected by wetting of ink because a wall 108 is formed on border portion of the ink supplying portion 102.

Figure 4A:
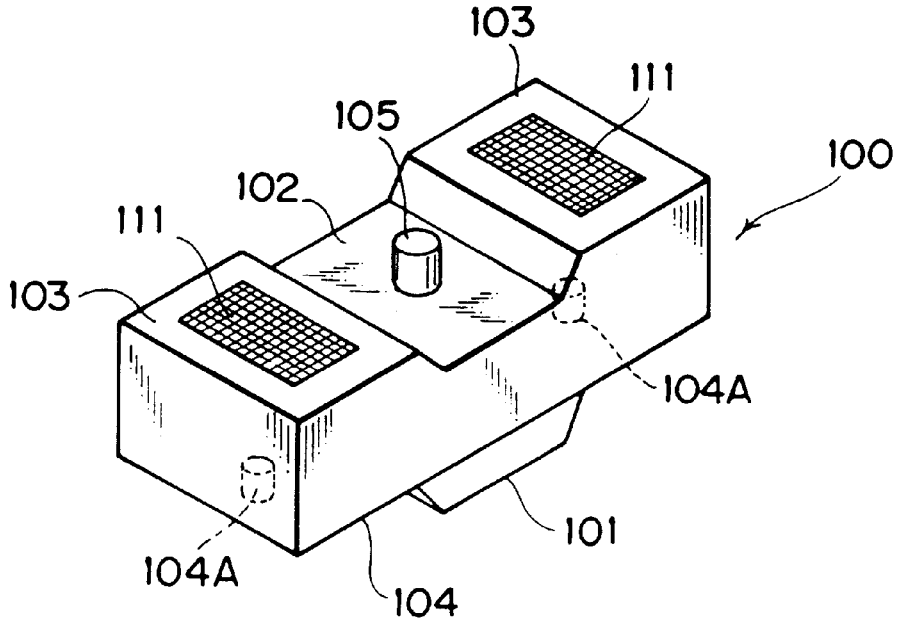
FIG. 4A is a perspective view of an ink jet head constructed according to a further embodiment of the present invention.
Figure 4B:
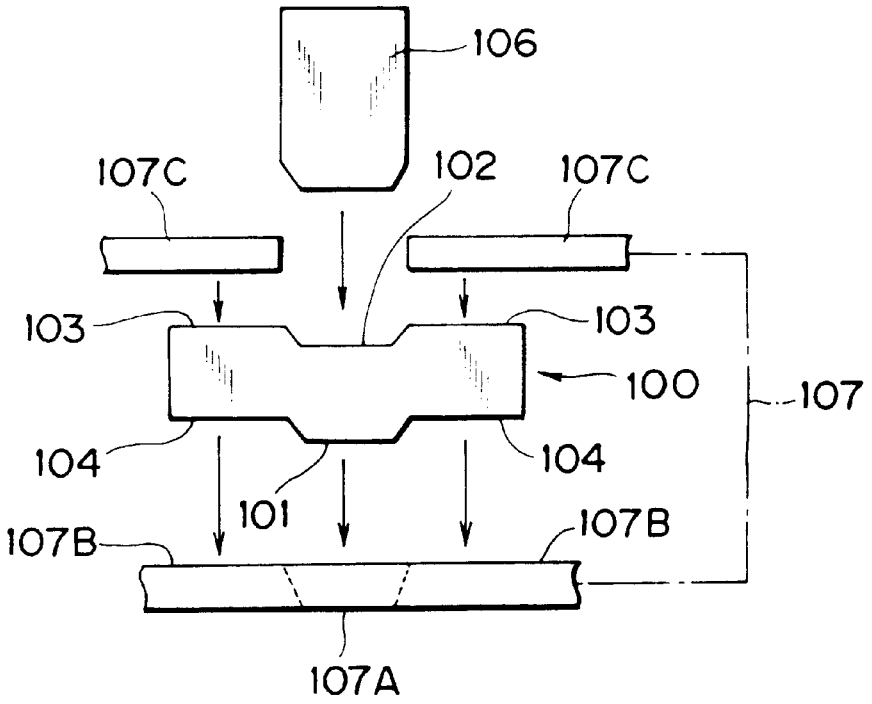
FIG. 4B is an illustrative view showing a connection relationship between outer components and the ink jet head shown in FIG. 4A.

FIGS. 4A and 4B show a further embodiment of the present invention. FIG. 4A shows by way of perspective view the structure of an ink jet head 100 constructed according to a third embodiment of the present invention wherein an ink supplying portion 102 and an ink ejecting portion 101 are disposed on the upper and lower surfaces of the ink jet head 100, that is on the opposite surfaces to each other, the positioning portion 104 is disposed on the same side as the ink ejecting portion 101 and different surface from the surface on which the ink ejecting portion 101 is disposed, and a pair of electric connecting portions 103 are disposed on the same side as the ink supplying portion 102 and different surfaces from the surface on which the ink supplying portion 102 is disposed. FIG. 4B shows by way of illustrative view the structure of an ink jet unit inclusive of the ink jet head 100 wherein securing of the ink jet head 100 to the carriage 107, electrical connection to be made between electrical components, connecting relationship between the ink tank 106 and the ink jet head 100 and connecting directions in which connecting operations between the ink jet head and other components are likewise represented.

Similarly to aforementioned embodiments, the ink supplying portion 102, the electric connecting portion 103 and the positioning portion 104 are arranged on different surfaces, respectively from the surface on which the ink ejecting portion is arranged. In addition, the electric connecting portion is arranged on the opposite side surface to the surface on which the ink ejecting portion is arranged, and is disposed on the same side as and above the ink ejecting portion, so as to be prevented from being affected by ink. On the other hand, the positioning portion is arranged on the same side surface as the ink ejecting portion. In this case, ink splash caused by the ink ejection more occasionally affects the positioning portion than that affected in the aforementioned embodiments. However, since the positioning portion is disposed above the ink ejecting portion, the former is prevented from being affected by leaked ink from the latter.

Furthermore, in this embodiment, the ink supplying portion 102 and the electric connecting portion 103 are arranged on the same side surfaces, and the positioning portion 104 is arranged on opposite side surface to the surfaces, thereby, the direction in which the ink tank 106 is attached to the ink jet head 100 coincides with the direction in which the electric connector 107C of the carriage 107 is connected to the electric connecting portion 103 of the ink jet head 100, and the force applied to the ink jet head 100 during a connecting operation at the electric connecting portion 103 is received by the positioning portion 104 and the fitting portion 107B, so that the ink jet head 100 is not dislocated from the carriage 107.

In last-described embodiment and the following embodiments to be described, the respective portions are arranged on different surfaces from each other, however, a plurality of portions are arranged on the same side surfaces. For this reason, advantage of attaching/detaching operability is less than that of the embodiments shown in FIGS. 1–3.

Next, a further embodiment will be described below.

Figure 5A:
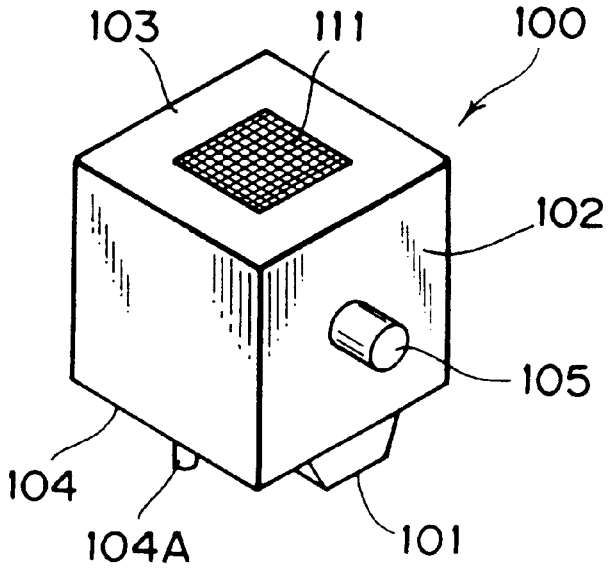
FIG. 5A is a perspective view of an ink jet head constructed according to a further embodiment of the present invention.
Figure 5B:
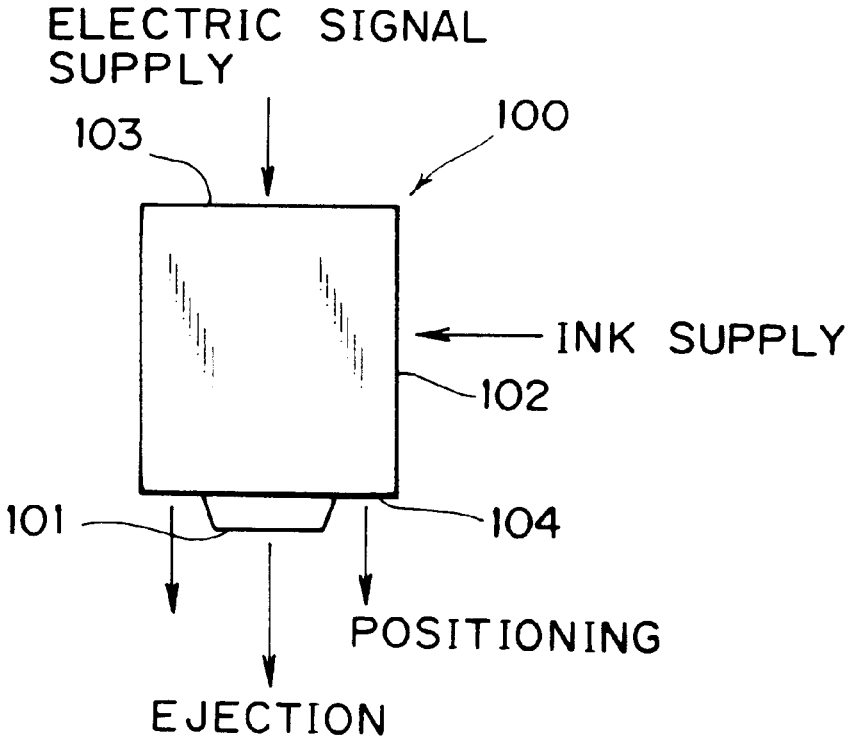
FIG. 5B is an illustrative view illustrating respective modes of functions of portions on the ink jet head shown in FIG. 5A as seen in the directions of respective actions.

A FIG. 5 shows by way of perspective view the structure of an ink jet head 100 constructed according to a fourth embodiment of the present invention wherein the ink ejecting portion 101 and the positioning portion 104 are disposed on the sane side and the different surfaces from each other in the stepped relationship, the electric connecting portion 103 is disposed on the upper surface of the ink jet head 100 located opposite to the ink ejecting portion 101, and the ink supplying portion 102 is disposed on one of four side surfaces extending at a right angle relative to the electric connecting portion 103. FIG. 5B shows by way of side view the direction of allowing the ink jet head 100 shown in FIG. 5A to be located on a carriage, the direction and electrical signals to be supplied to the ink jet head 100 at the time of a printing operation, and the direction of ink droplets to be ejected toward a printing paper.

Similarly to the aforementioned embodiments, the ink ejecting portion is arranged on the opposite side surface to the surfaces on which the respective portions are arranged respectively. The positional relationships between the electric connecting portion and the ink supplying portion, and between the electric connecting portion and the ink ejecting portion are same as that of the embodiment shown FIGS. 1 and 2 so that the same effect can be obtained. The positional relationship between the positioning portion, the ink ejecting portion and the electric connecting portion, and the effect by the relationship are the same as that of the embodiment shown in FIGS. 4A and 4B.

Figure 6A:
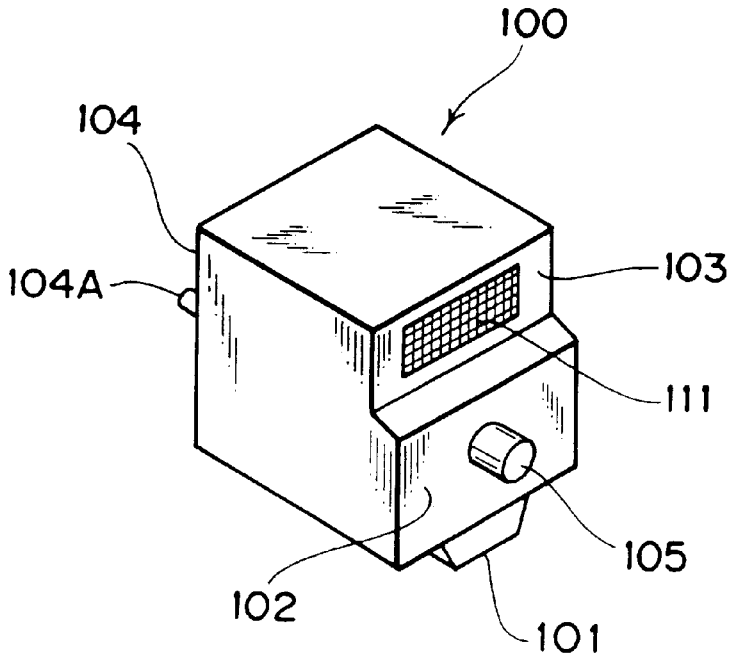
FIG. 6A is a perspective view of an ink jet head constructed according to a further embodiment of the present invention.
Figure 6B:
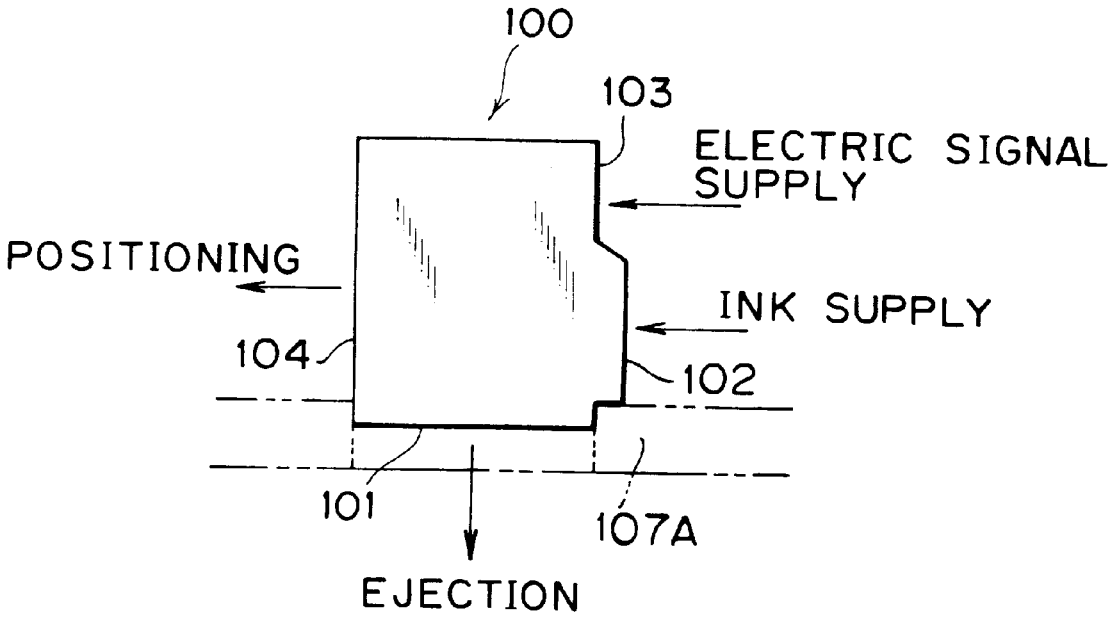
FIG. 6B is an illustrative view illustrating respective modes of function of portions on the ink jet head shown in FIG. 6A as seen in the direction of respective actions.

FIG. 6A shows by way of perspective view the structure of an ink jet head 100 constructed according to a fifth embodiment of the present invention wherein the positioning portion 104 is disposed on one of side surfaces extending at a right angle relative to the surface on which an ink ejecting portion 101 is disposed and the ink supplying portion 102 and the electric connecting portion 103 are disposed on the opposite side surfaces to the positioning portion 104 in the stepped state. FIG. 6B shows by way of schematic side view the contour of the ink jet head 100 shown in FIG. 6A wherein the direction of allowing each of the aforementioned portions to be connected is likewise represented by arrow marks.

Similarly to the aforementioned embodiments, the ink ejecting portion 101 is arranged on the different surface from the surfaces on which other portions 102–104 are arranged, respectively. The electric connecting portion 103 is disposed above the ink ejecting portion 101 and the ink supplying portion 102, and is disposed on the same side surface of the ink supplying portion 102. The border portion of the electric connecting portion 103 has stepped shape, so that the portion 103 can be prevented from being affected by the ink.

The arrangement of the positioning portion 104, the electric connecting portion 103 and the ink supplying portion 102, and the directions in which they are connected to the ink jet head 100 are the same as that of the embodiment shown in FIG. 4. The same effect can be also obtained.

Further embodiment will be described below.

Figure 7A:
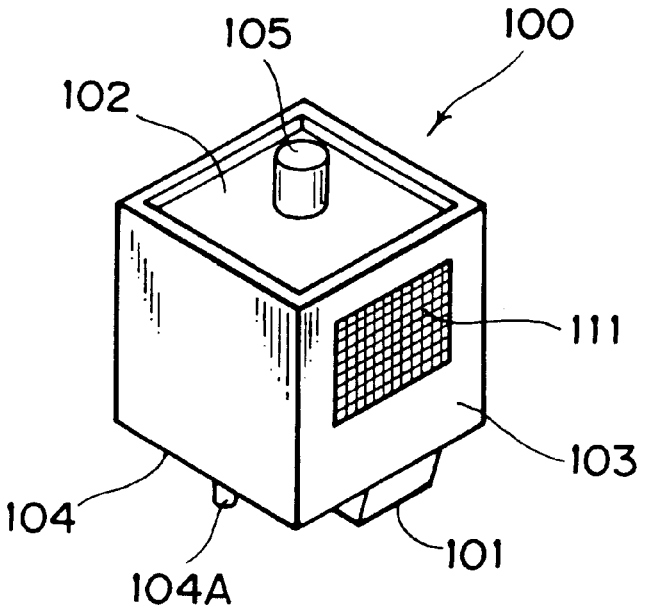
FIG. 7A is a perspective view of an ink jet head constructed according to further embodiment of the present invention.
Figure 7B:
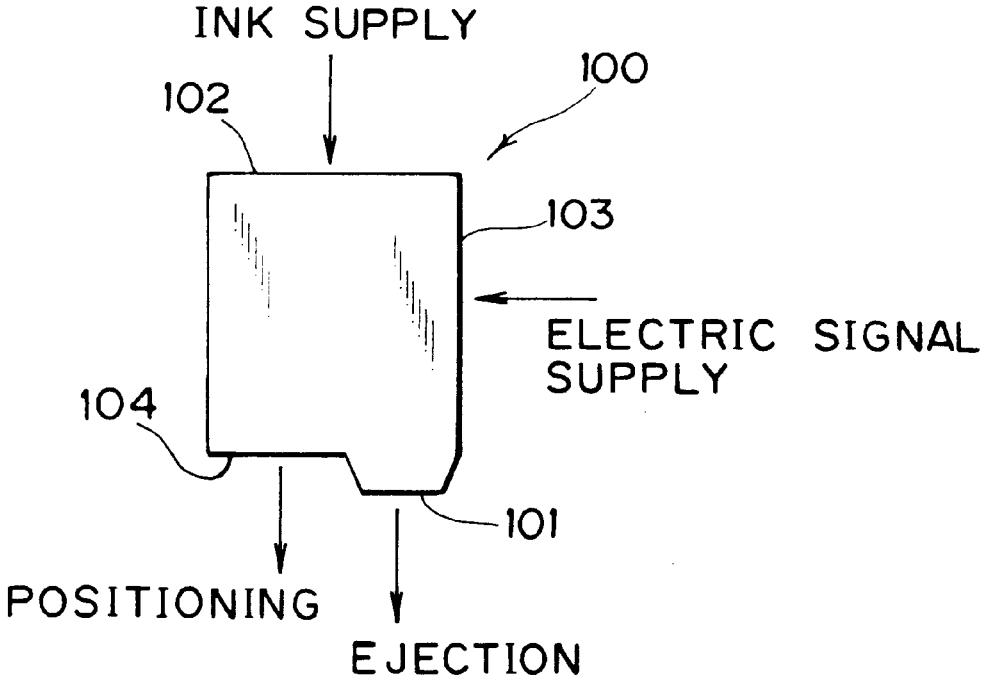
FIG. 7B is an illustrative view illustrating respective modes of functions of portions on the ink jet head shown in FIG. 7A as seen in the direction of respective actions.

FIG. 7A shows by way of perspective view the structure of an ink jet head 100 constructed according to a sixth embodiment of the present invention wherein the ink ejecting portion 101 and the positioning portion 104 are disposed on the lower surface side of the ink jet head 100 in the stepped relationship, that is, on the same side as and the different surface from the ink jet head 100, and the ink supplying portion 102 is disposed on the upper surface of the ink jet head 100 opposite to the ink ejecting portion 101 and the positioning portion 104, and the electric connecting portion 103 is disposed on one of four side surfaces of the ink jet head 100 extending at a right angle relative to the upper and lower surfaces of the same. FIG. 7B shows by way of schematic side view the contour of the ink jet head 100 wherein the direction of allowing each of the aforementioned portions to be connected is likewise represented by arrow marks.

The arrangement of the ink ejecting portion, the ink supply portion and the electric connecting portion, and the effect according to this arrangement are same as that of the embodiment shown in FIG. 3.

The positional relationships between the positioning portion and the ink supplying portion or the ink ejecting portion, and the effect of this relationship are same as that of the embodiment shown in FIG. 4.

The ink supplying portion 102 is surrounded by a wall member which projects from the ink supplying portion 102 so that the electric connecting portion 103 and other portions can be prevented from being wetted by ink from the ink supplying portion.

As is apparent from the above description regarding the embodiments according to the present invention, at least the ink ejecting portion is disposed on the different surface of the ink jet head from the surfaces on which other portions are disposed, and at least one of the electric connecting portion or the ink supplying portion is disposed on the opposite side surface to the surface on which the positioning portion is disposed.

With this construction, there does not arise a malfunction that electric contact between electrical components on the electrical connecting portion can not correctly be attained due to the deposition of ink mist and paper particles during each ink ejecting operation. In addition, the ink jet head can easily be located at a predetermined position and the dislocation of the ink jet head is restricted. Further, an assembly of the ink jet head and the ink tank can easily be attached to and detached from the carriage. In the case of a color printing apparatus including a plurality of ink jet units arranged on a common carriage in the parallel relationship wherein each empty ink tank and each used ink jet head can be replaced with new ones as desired, each locating operation can easily be achieved with the color printing apparatus. This can contribute to substantial improvement of a quality of recorded image.

Next, an example of an ink jet head constructed according to a modified embodiment of the present invention will be described below.

Figure 8:
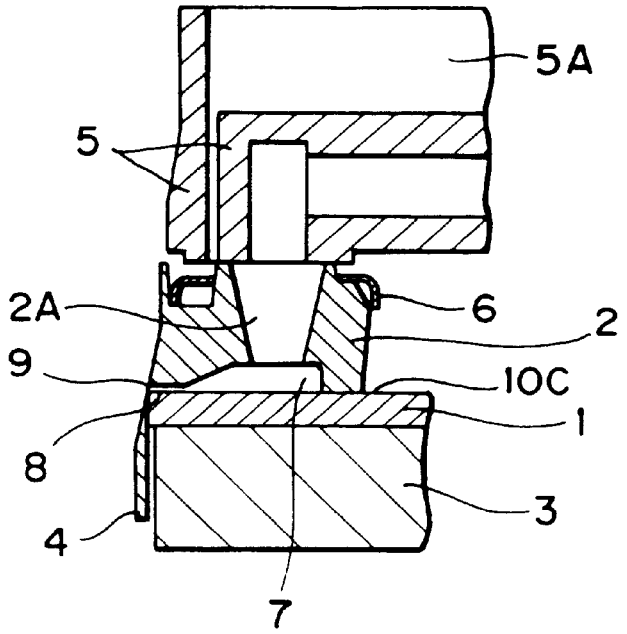
FIG. 8 is a fragmentary vertical sectional view of an ink jet head constructed according to one embodiment of the present invention.
Figure 9:
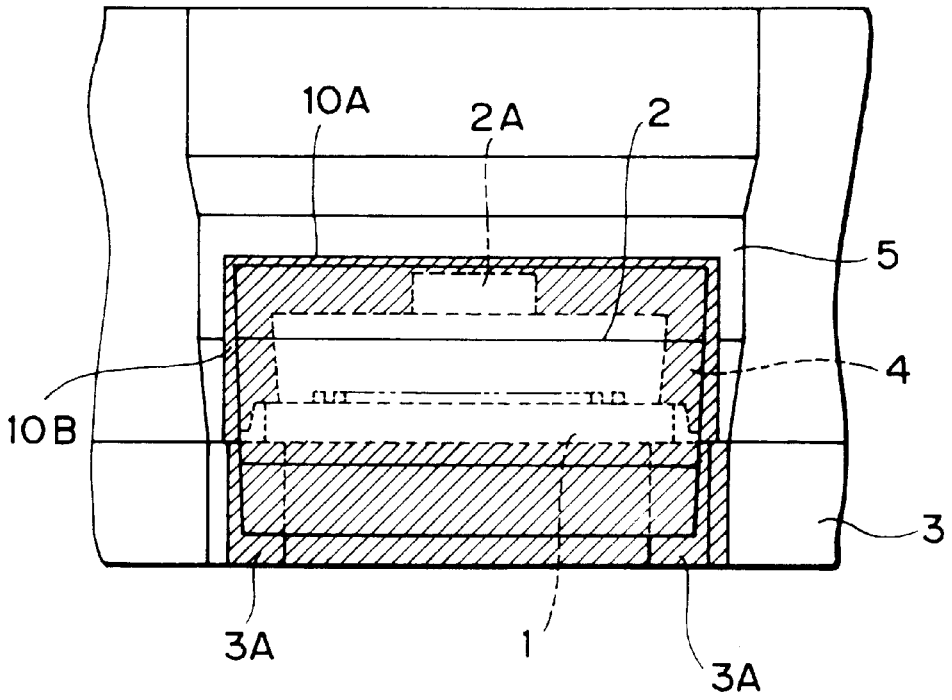
FIG. 9 is a partially sectioned front view of the ink jet head shown in FIG. 8.

Specifically, FIG. 8 and FIG. 9 show an ink jet head (hereinafter referred to as an IJH) 100 constructed according to a seventh embodiment of the present invention.

The ink jet head 100 includes a base plate 1 having an ink ejecting pressure generating element disposed thereon (hereinafter referred to as a heater board) and a ceiling plate 2 connected to the base plate 1 so as to form a liquid chamber 7 and a liquid path 8. An orifice plate 4 having an ink ejecting port 9 formed thereon is integrated with the ceiling plate 2, and the ink ejecting port 9 is communicated with the liquid path 8 so as to allow ink to be ejected therefrom.

The heater board 1 is fixedly secured to a support base plate 3 using an adhesive. In addition, the ceiling plate 2 is provisionally secured to the heater board 1 using an adhesive in such a manner that a heater section (not shown) serving as an ink ejecting pressure generating element is located in positional alignment with a groove constituting the liquid path 8, and the grooved orifice plate 4 is disposed in the form of an apron ahead of the foremost end surface of the support base plate 3.

Ink is supplied from an ink supplying member 5 to an ink supply port 2A formed through the ceiling plate 2. The ink supplying member 5 includes projection rods (not shown). Each of the projection rods is inserted into a through hole formed through the support base plate 3 so that it is immovably held in the support base plate 3 by thermal caulking.

Referring to FIG. 9, gaps 10A and 10B between the ink supplying member 5, the heater board 1 and the ceiling plate 2 and a gap between the grooved orifice plate 4 and the foremost end surface of the support base plate 3 are filled with an adhesive based sealing material.

It is acceptable that the gap between the grooved orifice plate 4 and the support base plate 3, i.e., a groove 3A therebetween is dimensioned to be wide enough to enable the groove 3A to be sufficiently filled with a certain sealing material. After completion of the provisional securing of the ceiling plate 2 to the heater board 1, the ceiling plate 2 is firmly retained by a retaining spring 6.

It should be noted that it is important that the groove 3A recessed in the support base plate 3 forms a space which is communicated with the gap between the grooved orifice plate 4 and the support base plate 3. It is not desirable that the groove 3A is fully covered with the grooved orifice plate 4 or it is isolated from the gaps 10A and 10B. This is because that the flow path for the sealing material is shut out with the fully covered groove 3A, resulting in good sealing failing to be attained.

The sealing material is poured through a sealing material pouring port (not shown) formed at the upper part of the ink supplying member 5 so that a wire bonding portion serving to transmit a series of electrical signals is covered with the sealing material, and at the same time, the gaps 10A and 10B are filled with the same. In addition, the sealing material flows past the groove 3A formed in the support base plate 3 so that the gap range between the grooved orifice plate 4 and the support base plate 3 is fully filled with the sealing material as represented by hatched lines in FIG. 9. To assure that each gap is filled with the sealing material without any possibility that the ink ejecting port 9 is closed with it, it is necessary that the sealing material exhibits adequate thixotropy and viscosity. If the sealing material exhibits an excessively low viscosity, it penetrates into the liquid path 8 and the ink ejecting port 9 formed in the ceiling plate 2, causing them to be closed with the sealing material. On the contrary, if it exhibits an excessively high viscosity, the peripheral part of the grooved orifice plate 4 is not covered with the sealing material.

According to the present invention, the viscosity of the sealing material is set to 1,000 to 15,000 cps, more preferably 2,000 to 10,000 cps and most preferably 4,000 to 10,000 cps.

It is required that the sealing material exhibits an excellent property of adhesiveness to the heater board 1 made of a silicon wafer, the support base plate 3 be made of a metallic material, the base plate 2, the grooved ceiling plate 4 and the ink supplying member 5 each be molded of a synthetic resin. In addition, to assure that a plurality of components each made of a different kind of material having a different thermal expansion coefficient are connected to each other, it is necessary that a soft material capable of absorbing a difference of the thermal expansion coefficients among these different materials attributable to variation of the environmental temperature, i.e., a sealing material exhibiting a hardness of JIS Standard A100 or less is employed for the purpose of connecting the associated components to each other.

On the other hand, since the sealing material serves to cover a wire bonding portion 10C therewith for the purpose of protection, it is necessary that a material which does not corrode an aluminum wire bonding portion and an aluminum electrode is employed for the sealing material. To assure that the electrode and the wire bonding portion are not corroded at all, it is preferable that a concentration of ions of impurities involved in the sealing material such as $Cl^-$, $Na^+$ or the like is set to 30 ppm or less.

Since the sealing material is locally brought in contact with the ink, it is required that it has excellent properties in respect of ink-resisting capability, solvent-resisting capability and alkali-resisting capability. Additionally, it is required that it exhibits low permeability against oxygen, nitrogen and steam.

Next, a process of assembling the aforementioned essential components constituting the ink jet head together will be described below with reference to FIG. 10.

Figure 10:
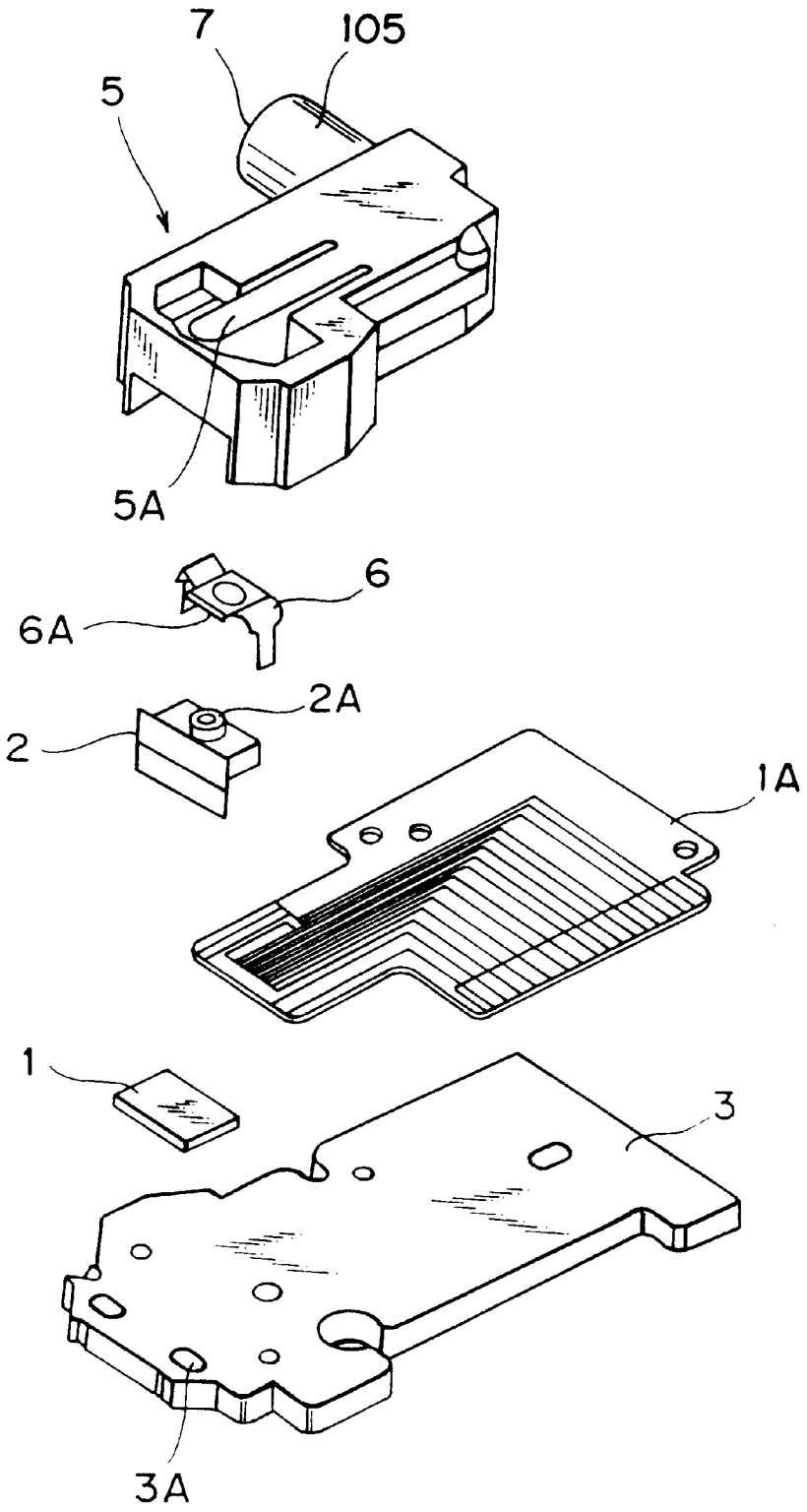
FIG. 10 is a perspective view of the ink jet head shown in FIG. 8 and FIG. 9, particularly showing essential components constituting the ink jet head in the disassembled state.

In FIG. 10, reference numeral 1A designates a wiring board. The wiring board 1A includes a plurality of electrothermal converting elements (each serving as an ejecting heater) and two electricity feeding aluminum wires formed on a silicon substrate by employing a film forming process. In addition, the wiring board 1A includes a heater board 1 and a pad (not shown) located at the end of each wire extending from the heater board 1 to receive a series of signals from the main body side of an ink jet apparatus (not shown), and wires extending from the heater board 1 are connected to the opponent wires extending from the wiring board 1A via, e.g., a wire bonding portion).

Reference numeral 2 designates a ceiling plate. The ceiling plate 2 includes an ink receiving port 2A for receiving the ink supplied from an ink tank (not shown) and then delivering it to a common liquid chamber therethrough. A grooved orifice plate 4 having a plurality of ejecting ports 9 formed thereon corresponding to a plurality of ink paths 8 is integrated with the ceiling plate 2. It is preferable that the integrated assembly consisting of the ceiling plate 2 and the grooved orifice plate 4 is molded of a polysulfone resin. Alternatively, it may be molded of any other kind of synthetic resin preferably employable for the purpose of ink ejection.

Reference numeral 3 designates a support base plate made of a metallic material to support the wiring base plate 1A from below. Reference numeral 6 designates a retaining spring having a substantially M-shape contour. The common liquid chamber is slightly resiliently squeezed by the central part of the retaining spring 6 corresponding to the central part of the substantially M-shaped contour, and moreover, a part of the liquid paths 8, preferably, the range of the ceiling plate 2 in the vicinity of the ejection ports 9 is slightly resiliently squeezed by an apron portion 6A of the retaining spring 6. Since both the foot portions of the retaining spring 6 vertically extend through holes 3A of the heater board 1 so as to allow the ceiling plate 2 to be secured to the heater board 1 while the heater board 1 is clamped between the ceiling plate 2 and the support base plate 3, the ceiling plate 2 is firmly held on the heater board 1 by the resilient force of the retaining spring 6. An ink supplying member 5 includes an ink introduction tube 5A communicated with an ink supplying tube 105, and the ink introduction tube 5A is held in the cantilever-like fashion while the ink supplying tube 105 serves as a stationary side. To assure that a capillary phenomenon appears in the region between the stationary side of the ink introduction tube SA and the ink supplying tube 105, a sealing ball (not shown) is inserted in the foregoing region. In addition, reference numeral 7 designate a filter disposed on the inlet side of the ink supplying tube 105.

Since the ink supplying member 5 is molded of a synthetic resin by employing an injection molding process, it can be produced not only at an inexpensive cost but also at a high accuracy. Additionally, since the ink introduction tube 5A is brought in close contact with the ink receiving port 2A of the ceiling plate 2 by the elastic force of the ink introduction tube 5A designed in the cantilever-like contour, the close contact state of the ink introduction tube 5A relative to the ink receiving port 2A of the ceiling plate 2 can stably be maintained also in the case that a number of ink jet heads are produced on a mass production line. In this embodiment, the completely communicated state can be obtained merely by pouring a sealing adhesive from the ink supplying member 5 side while the foregoing close contact state is maintained. It should be noted that fixing of the ink supplying member 5 to the support base plate 3 can simply be achieved by fitting a plurality of pins (not shown) projecting from the lower surface of the ink supplying member 5 into the corresponding holes formed through the support base plate 3 and then thermally fusing a part of each pin projected from the lower surface of the support base plate 3 to weld the pins to the support base plate 3.

Next, an example of the case that the present invention is applied to a plurality of ink jet heads, i.e., the case that a plurality of ink jet heads are assembled together as an integrated unit and the corresponding ink tanks are attached to and detached from the integrated unit to constitute an ink head unit (hereinafter referred to as a head device) will be described below.

Figure 11:
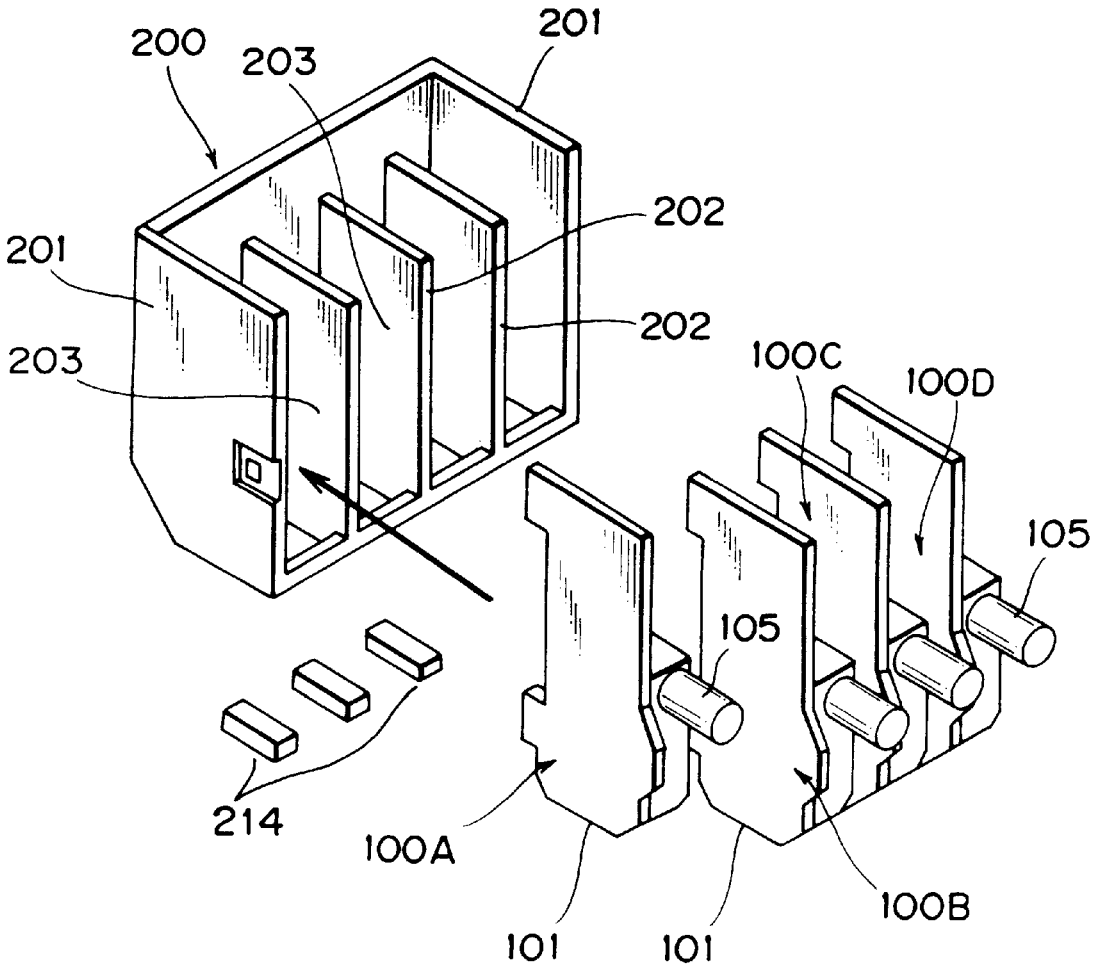
FIG. 11 is a perspective view of an ink jet unit including an ink jet head constructed according a further embodiment of the present invention for performing a color printing operation, particularly showing a step of assembling essential components constituting the ink jet unit together.
Figure 12:
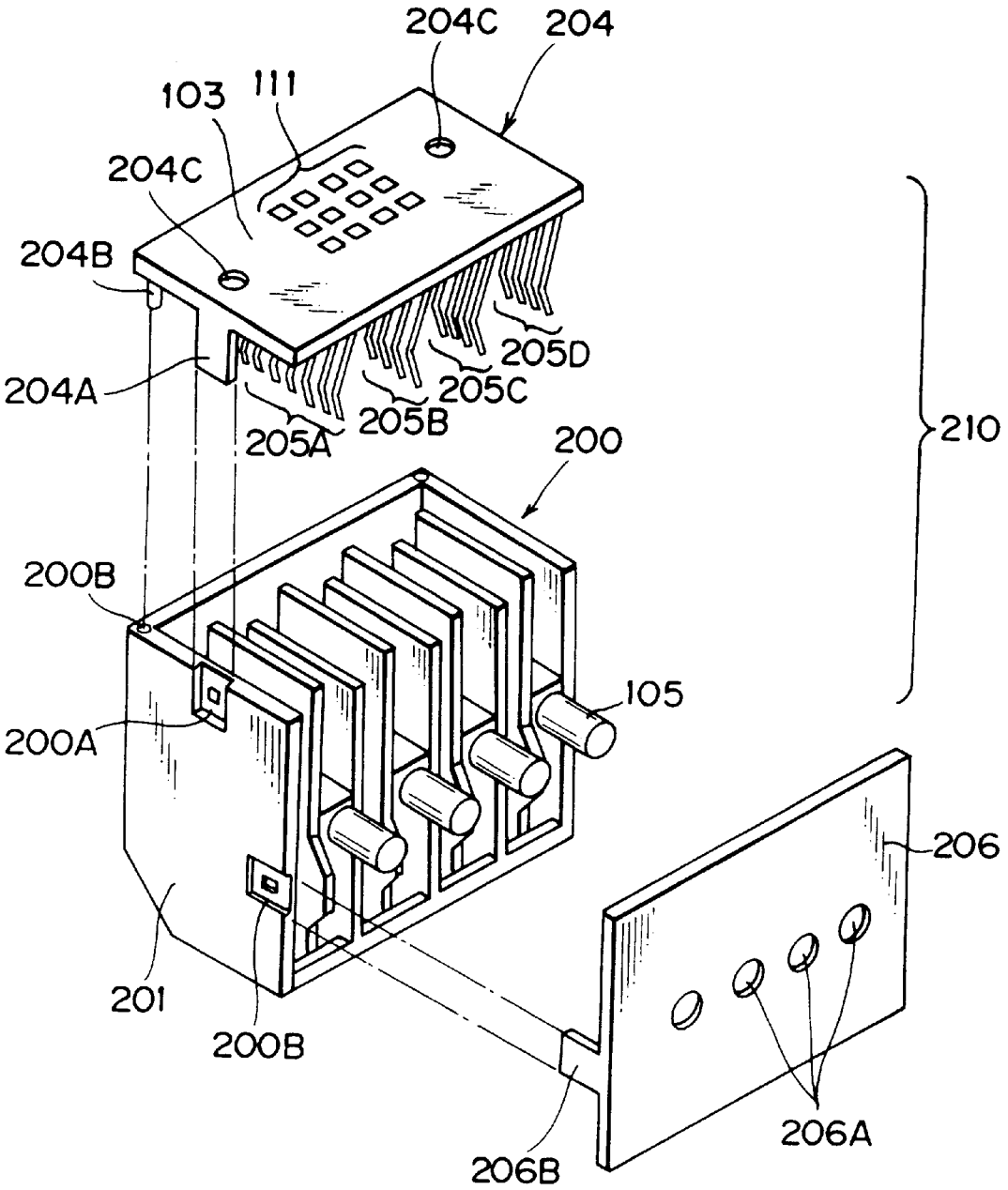
FIG. 12 is a perspective view of the ink jet unit shown in FIG. 11, particularly showing essential components constituting the ink jet unit at a step subsequent to the foregoing assembling step.
Figure 13:
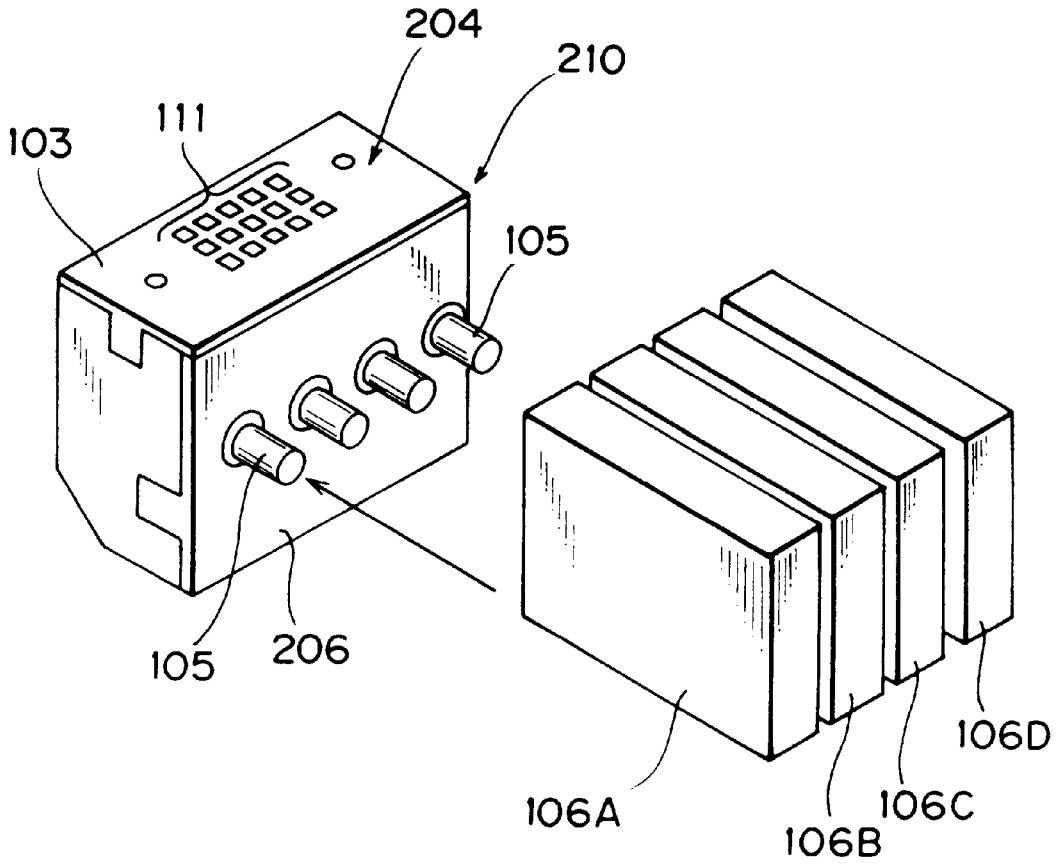
FIG. 13 is a perspective view of the ink jet unit shown in FIG. 12, particularly showing a step subsequent to the assembling step, i.e., a stop of fitting an ink tank to the ink jet unit.

FIG. 11 to FIG. 13 show a head device of the foregoing type constructed according to an eighth embodiment of the present invention. In this embodiment, four ink jet heads 100A, 100B, 100C and 100D for ejecting four kinds of inks each having a different color are held in a unit frame 200 in the fitted state. Otherwise, in the case that the ink jet heads 100A, 100B, 100C and 100D contain a single kind of ink, a recording operation can be performed at a high speed by simultaneously ejecting the ink from the respective ink jet heads 100A, 100B, 100C and 100D. At any rate, it goes without saying that it is necessary that they are held in the unit frame 200 while maintaining a high accuracy relative to each other.

As shown in FIG. 11, the unit frame 200 includes two outer frames 201 and three inner partition plates 202 to define four unit holding portions 203. In the shown case, the ink jet heads 100A, 100B, 100C and 100D are fitted into the unit holding portions 203 in the arrow-marked direction while each ink ejecting portion 101 is oriented in the downward direction. Reference numeral 214 designates a plurality of color mixing preventive members each made of a porous material. Each color mixing preventive member 214 is disposed between adjacent ink jet heads in order to prevent an ink received in one ink jet head while having a different color from being delivered to the ink ejecting surface of the adjacent ink jet head when the ink ejecting surface is wiped by actuating a wiper at the time of a color printing operation.

FIG. 12 shows by way of perspective view a step of assembling the aforementioned components together to build a single head device 210 after the ink jet heads 100A, 100B, 100C and 100D are fitted into the corresponding unit holding portions 203 as shown in FIG. 11. Here, reference numeral 204 designates a connector plate including an electrical connecting portion 103 having a plurality of electrical contacts 111 formed on the upper surface thereof. A plurality of connector pins 205A, 205B, 205C and 205D for connecting the electrical contacts 111 to a plurality of contacts (not shown) disposed on the ink jet heads 100A, 100B, 100C and 100D are arranged on the lower surface side of the connector plate 204. Reference numerals 204A designates a fixing arm, and reference numeral 204B designates a locating pin. The fixing arms 204A and the locating pins 204B are projected downward from the opposite ends of the connector plate 204 toward fixing grooves 200A and pin holes 200B formed on the unit frame 200. In addition, reference numeral 204C designates two locating holes, respectively, which serve to locate the assembled head device 210 at a predetermined position on a carriage.

Reference numeral 206 designates a cover member for protecting the components received in the head device 210 from damage or injury. Four holes 206A are formed through the cover member 206 so as to allow ink supplying ports 105 of the ink jet heads 100A, 100B, 100C and 100D to be inserted therethrough. Fixing arms 206B projecting from the opposite ends of the cover plate 206 are fitted into fixing grooves 200B on the unit frame 200. FIG. 13 shows by way of perspective view the structure of the head device 210 to be assembled with the ink tanks 106A, 106B, 106C and 106D in order to build an ink jet unit. The ink tanks 106A, 106B, 106C and 106D are fitted to the corresponding ink jet heads received in the head device 210 via ink supplying ports 105. When inks contained in the ink tanks 106A, 106B, 106C and 106D are consumed, they are replaced with new ones.

Figure 14:
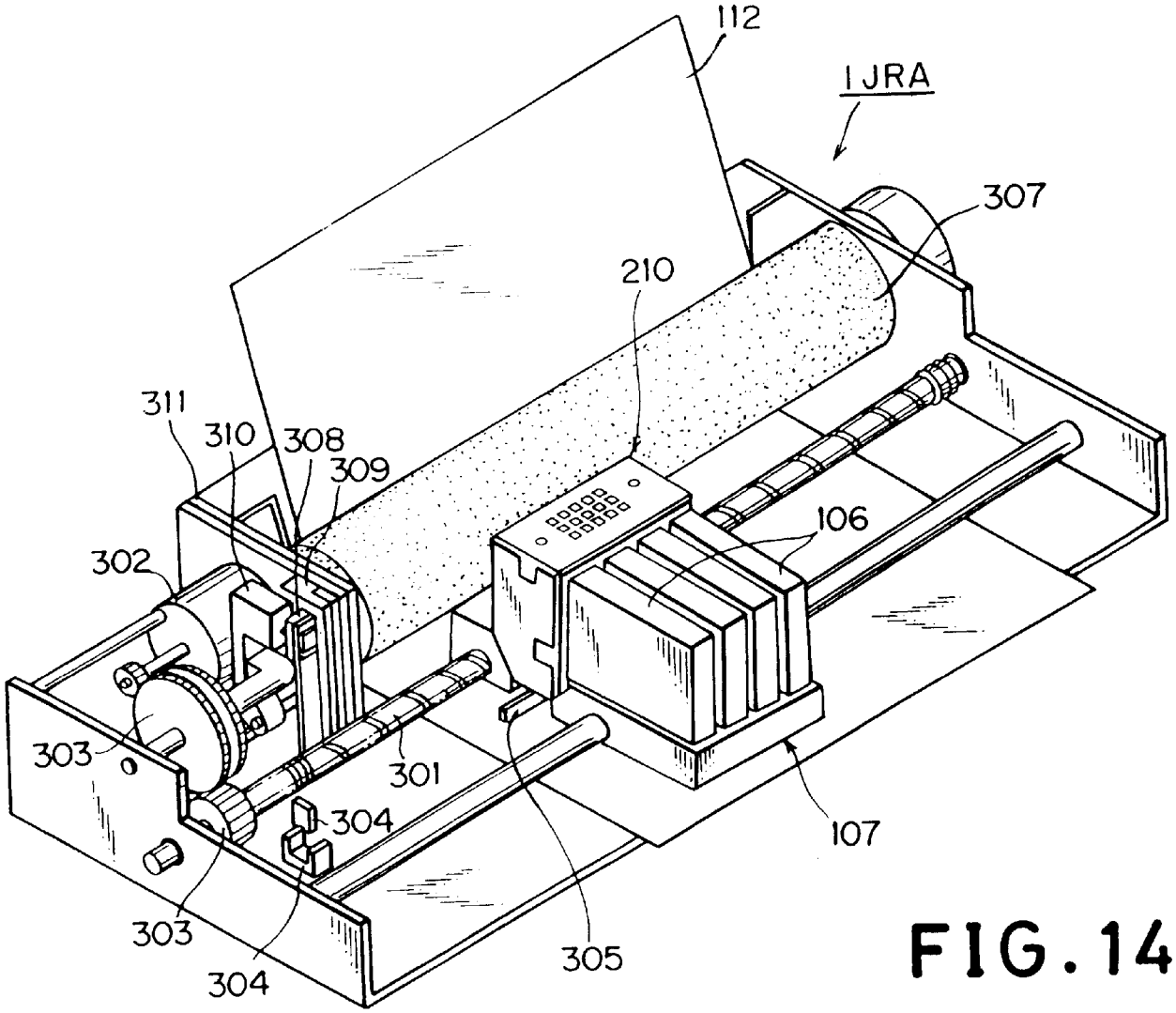
FIG. 14 is a perspective view of an ink jet printing apparatus constructed according to one embodiment of the present invention, particularly showing the whole structure of the ink jet printing apparatus.

FIG. 14 shows by way of perspective view the structure of an ink jet printing apparatus constructed according to a ninth embodiment of the present invention wherein each printing operation is performed with the ink jet printing apparatus while the head device 210 shown in FIG. 13 is mounted on a carriage 107.

Reference numeral 301 designates a lead screw threadably engaged with a part of the carriage 107 to displace the latter along a printing sheet 112, reference numeral 302 designates a driving motor for rotationally driving the lead screw 301, reference numeral 303 designates a pair of gears for transmitting the driving power of the driving motor 302 to the lead screw 301 via the gears 303, reference numeral 304 designates photo-couplers for detecting the carriage 107 when the latter is displaced in the vicinity of a home position, and reference numeral 305 designates a lever projected from the carriage 107 side to open or shut out a light path for the photo-couplers 304. With this construction, when the carriage 107 is displaced to the position operatively associated with the photo-couplers 304, this is detected by the photo-couplers 304 in order to shift the rotation of the driving motor 302 in the normal direction to the rotation of the same in the reverse direction, and vice versa.

On the other hand, the printing sheet 112 is thrust against a platen 307 via a retaining plate 306 by activating a sheet feeding unit (not shown) so that it is fed in the forward direction via the platen 307 every time a printing operation is achieved by the head device 210 in accordance with the information derived from scanning. Reference numeral 308 designates a cap member, reference numeral 309 designates a cleaning blade, reference numeral 310 designates a pumping unit for activating each recording head received in the head device 210, and reference numeral 311 designates a supporting member for supporting the cap member 308, the cleaning blade 309 and so forth.

Since a printing operation to be performed by the ink jet printing apparatus and an activating operation to be performed for each printing head received in the head device are well known for any expert in the art, description on these operations is herein neglected for the purpose of simplification. In this embodiment, since the respective ink jet heads are held in the head device 210 while they are correctly registered relative to the ink jet unit at a high accuracy, a high quality of printed image is assured with the ink jet printing apparatus. Additionally, the used printing head can easily be replaced with new one, and moreover, when ink contained in each ink tank is consumed, the empty ink tank can easily be replaced with a new one.

The present invention achieves distinct effects when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet head which is detachably mounted and used in an apparatus having a fitting portion for positioning said ink jet head, and a connecting portion for supplying signals to said ink jet head, said head comprising:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to the connecting portion of the apparatus; and a plurality of outer surfaces on which said ink ejecting portion, said positioning portion, said ink supplying portion and said electric connecting portion are disposed, wherein said positioning portion, said ink supplying portion and said electric connecting portion are disposed on outer surfaces of said plurality of outer surfaces different from an outer surface of said plurality of outer surfaces on which said ink ejecting portion is disposed, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between said outer surface on which said electric portion is disposed and the outer surface on which the ink supplying portion is disposed.

2. An ink jet head as claimed in claim 1, wherein said electric connecting portion is disposed above said ink ejecting portion.

3. An ink jet head as claimed in claim 1 or 2, wherein at least a portion of said positioning portion is disposed above said ink ejecting portion and said ink supplying portion.

4. An ink jet head as claimed in claim 1, wherein the outer surface on which said ink ejecting portion is disposed and the outer surface on which said positioning portion is disposed are located opposite to the outer surface on which said ink supplying portion is disposed and opposite to the outer surface on which said electric connecting portion is disposed.

5. An ink jet head as claimed in claim 1, wherein said ink jet head includes a plurality of head elements integrated therewith.

6. An ink jet head as claimed in claim 5 wherein each of said head elements includes a plurality of ink supplying ports which constitute said ink supplying portion and wherein plural kinds of inks are supplied to said ink jet head through said plurality of ink supplying ports.

7. An ink jet head as claimed in claim 1 or wherein said ink jet head comprises an electro-thermal converting element for producing thermal energy to generate a bubble so as to allow ink to be ejected through said ink electing port.

8. An ink jet head as claimed in claim 1, wherein said ink ejecting portion is disposed on the outer surface so that said ink ejecting port faces downward.

9. An ink jet head which is detachably mounted and used in an apparatus having a fitting portion for positioning said ink jet head, and a connecting portion for supplying signals to said ink jet head, said head comprising:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to the connecting portion of the apparatus; and a plurality of outer surfaces on which said ink ejecting portion, said positioning portion, said ink supplying portion and said electric connecting portion are disposed, wherein said plurality of outer surfaces are individually assigned to said ink ejecting portion, said positioning portion, said ink supplying portion and said electric connecting portion, each of which is separately disposed on one of said plurality of outer surfaces, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between the outer surface on which said electric connecting portion is disposed and the outer surface on which said ink supplying portion is disposed.

10. An ink jet head as claimed in claim 9, wherein said ink ejecting portion is disposed on the outer surface so that said ink ejecting port faces downward.

11. An ink jet unit comprising:

an ink jet head which is detachably mounted and used in an apparatus having a fitting portion for positioning said ink jet head, and a connecting portion for supplying signals to said ink jet head, said head comprising:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to said connecting portion of the apparatus;

a plurality of outer surfaces on which said ink ejecting portion, said positioning portion, said ink supplying portion and said electric connecting portion are disposed;

wherein said positioning portion, said ink supplying portion and said electric connecting portion are disposed on outer surfaces of said plurality of outer surfaces different from an outer surface of said plurality of outer surfaces on which said ink ejecting portion is disposed, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between the outer surface on which said electric connecting portion is disposed and the outer surface on which said ink supplying portion is disposed; and an ink container which is detachably connected to said ink head and which stores ink to be supplied to said ink jet head through said ink supplying portion.

12. The ink jet unit as claimed in claim 11, wherein said electric connecting portion is disposed above said ink ejecting portion.

13. The ink jet unit as claimed in claim 11 or 12, wherein at least a portion of said positioning portion is disposed above said ink ejecting portion and said ink supplying portion.

14. An ink jet unit as claimed in claim 11, wherein the outer surface on which said ejecting portion is disposed and the outer surface on which said positioning portion is disposed are located opposite to the outer surface on which said ink supplying portion is disposed and opposite to the outer surface on which said electric connecting portion is disposed.

15. An ink jet unit as claimed in claim 11, wherein said ink jet head includes a plurality of head elements integrated therewith.

16. An ink jet unit as claimed in claim 11, comprising a plurality of ink jet heads as said ink jet head, wherein each of said plurality of ink jet heads includes an ink supplying port which constitute said ink supplying portion, and wherein plural kinds of inks are supplied to said ink jet unit through said plurality of ink supplying ports.

17. An ink jet unit as claimed in claim 11, wherein said ink ejecting portion is disposed on the outer surface so that said ink ejecting port faces downward.

18. An ink jet unit comprising:

an ink jet head which is detachably mounted and used in an apparatus having a fitting portion for positioning said ink jet head, and a connecting portion for supplying signals to said ink jet head, said head comprising:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to the connecting portion of the apparatus; and a plurality of outer surfaces on which said ink ejecting portion, said positioning portion, said ink supplying portion and said electric connecting portion are disposed, wherein said plurality of outer surfaces are individually assigned to said ink ejecting portion, said positioning portion, said ink supplying portion and said electric connecting portion, each of which is separately disposed on one of said plurality of outer surfaces, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between the outer surface on which said electric connecting portion is disposed and the outer surface on which said ink supplying portion is disposed; and an ink container which is detachably connected to said ink jet head and which stores ink to be supplied to said ink jet head through said ink supplying portion.

19. An ink jet unit as claimed in claim 18 wherein said ink ejecting portion is disposed on the outer surface so that said ink ejecting port faces downward.

20. An ink jet apparatus for ejecting ink to a recording medium to adhere the ink to the medium, said apparatus comprising:

an ink jet head; and a carriage on which said ink jet head is detachably mounted for moving said ink jet head, said carriage comprising a fitting portion for positioning said ink jet head and a connecting portion for supplying signals to and receiving signals from said ink jet head, wherein said ink jet head comprises:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to the connecting portion of said carriage; and a plurality of outer surfaces on which said ink ejecting portion, said positioning portion, said ink supplying portion and said electric connecting portion are disposed, wherein said positioning portion, said ink supplying portion and said electric connecting portion are disposed on an outer surface of said plurality of outer surfaces different from an outer surface of said plurality of outer surfaces on which said ink ejecting portion is disposed, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between the outer surface on which said electric connecting portion is disposed and the outer surface on which said ink supplying portion is disposed.

21. An ink jet apparatus as claimed in claim 20, wherein said electric connecting portion is disposed above said ink ejecting portion.

22. An ink jet apparatus as claimed in claim 20 or 21, wherein at least a portion of said positioning portion is disposed above said ink ejecting portion and said ink supplying portion.

23. An ink jet apparatus as claimed in claim 20, wherein the outer surface on which said ink ejecting portion is disposed and the outer surface on which said positioning portion is disposed are located opposite to the outer surface on which said ink supplying portion is disposed and opposite to an outer surface on which said electric connecting portion is disposed.

24. An ink jet apparatus as claimed in claim 20, wherein said ink jet head includes a plurality of head elements integrated therewith.

25. An ink jet apparatus as claimed in claim 24, wherein each of said head elements includes a plurality of ink supplying ports which constitute said ink supplying portion and wherein plural kinds of inks are supplied to said ink jet head through said plurality of ink supplying ports.

26. An ink jet apparatus as claimed in claim 20, wherein said ink ejecting portion is disposed on the outer surface so that said ink ejecting port faces downward.

27. An ink jet apparatus for ejecting ink to a recording medium to adhere the ink to the medium, said apparatus comprising:

an ink jet head; and a carriage on which said ink jet head is detachably mounted for moving said ink jet head, said carriage comprising a fitting portion for positioning said ink jet head and a connecting portion for supplying signals to said ink jet head, wherein said ink jet head comprises:

an ink ejecting portion having an ink ejecting port so as to eject ink through said ink ejecting port;

a positioning portion for definitely determining a position of said ink jet head relative to the apparatus when said ink jet head is fitted to the apparatus;

an ink supplying portion which is detachably connected to an ink supplying means of an ink container for supplying ink to said ink jet head;

an electric connecting portion electrically connected to the connecting portion of said carriage; and a plurality of outer surfaces on which said ink ejecting portion, said positioning portion, said ink supplying portion and said electric connecting portion are disposed, wherein said plurality of outer surfaces are individually assigned to said ink ejecting portion, said positioning portion, said ink supplying portion and said electric connecting portion, each of which is separately disposed on one of said plurality of outer surfaces, the outer surface on which said positioning portion is disposed is positioned opposite to respective outer surfaces on which said ink supplying portion and said electric connecting portion are respectively disposed, and the outer surface on which said electric connecting portion is disposed is positioned above the outer surface on which said ink supplying portion is disposed, with a step portion between the outer surface on which said electric connecting portion is disposed and the outer surface on which said ink supplying portion is disposed.

28. An ink jet apparatus as claimed in claim 27, wherein said electric connecting portion is disposed above said ink ejecting portion.

29. An ink jet apparatus as claimed in claim 27 or 28, wherein at least a portion of said positioning portion is disposed above said ink ejecting portion and said ink supplying portion.

30. An ink jet apparatus as claimed in claim 27, wherein the outer surface on which said ink ejecting portion is disposed and the outer surface on which said positioning portion is disposed are located opposite to the outer surface on which said ink supplying portion is disposed and opposite to an outer surface on which said electric connecting portion is disposed.

31. An ink jet apparatus as claimed in claim 27, wherein said ink jet head includes a plurality of head elements integrated therewith.

32. An ink jet apparatus as claimed in claim 31, wherein each of said head elements includes a plurality of ink supplying ports which constitute said ink supplying portion and wherein plural kinds of inks are supplied to said ink jet head through said plurality of ink supplying ports.

33. An ink jet apparatus as claimed in claim 27, wherein said ink ejecting portion is disposed on the outer surface so that said ink ejecting port faces downward.

* * * * *

UNITED STATES PATENT AND TRADEMARK OFFICE

CERTIFICATE OF CORRECTION

PATENT NO. : 6,151,051
DATED : November 21, 2000
INVENTOR(S) : Ikeda et al.

It is certified that error appears in the above-identified patent and that said Letters Patent is hereby corrected as shown below:

Item [57] Abstract,
Line 7, "an ink" should read -- to an ink. --

Column 1,
Line 21, "most of" should read -- most --.

Column 3,
Line 15, "head, ink" should read -- head, an ink --.

Column 4,
Line 50, "a another" should read -- another --.

Column 5,
Line 23, "according a" should read -- according to a --.
Line 47, "referred" should read -- referred to --.

Column 6,
Line 27, "can not" should read -- cannot --.
Line 54, "Lo" should read -- to --.
Line 55, "account of" should read -- account --.

Column 7,
Line 53, "need" should read -- needed --.

Column 8,
Line 21, "a arrangement" should read -- an arrangement --.
Line 39, "a taper" should read -- taper --.

Column 9,
Line 4, "isolutedly" should read -- isolatedly --.
Line 14, "10" should be deleted.
Line 63, "arid" should read -- and --.

Column 10,
Line 3, "104" should read -- 104A --, and "opponent" should read -- opposing --.
Line 5, "opponent" should read -- opposing --.
Line 56, "thereby," should read -- whereby --.

UNITED STATES PATENT AND TRADEMARK OFFICE

CERTIFICATE OF CORRECTION

PATENT NO. : 6,151,051
DATED : November 21, 2000
INVENTOR(S) : Ikeda et al.

It is certified that error appears in the above-identified patent and that said Letters Patent is hereby corrected as shown below:

Column 11,
Line 1, "other," should read -- other; --.
Line 6, "A Fig. 5" should read -- FIG. 5A --.
Line 28, "shown" should read -- shown in --.
Line 61, "Further" should read -- A further --.

Column 12,
Line 18, "this relationship" should read -- these relationships --.
Line 35, "can not" should read -- cannot --.

Column 13,
Line 30, "or it is" should read -- or is --.
Line 31, "that" should be deleted.

Column 14,
Line 35, "via," should read -- (via, --.

Column 15,
Line 3, "tube SA" should read -- tube 5A --.
Line 5, "designate" should read -- designates --.

Column 16,
Line 10, "numerals" should read -- numeral --.

Column 17,
Line 7, "description on" should read -- description of --.

Column 19,
Line 14, "electric portion" should read -- electric connecting portion --.
Line 15, "the ink" should read -- said ink --.
Line 32, "claim 5" should read -- claim 5, --.
Line 37, "1 or" should read -- 1 or 6, --.
Line 40, "electing" should read -- ejecting --.

UNITED STATES PATENT AND TRADEMARK OFFICE

CERTIFICATE OF CORRECTION

PATENT NO. : 6,151,051
DATED : November 21, 2000
INVENTOR(S) : Ikeda et al.

It is certified that error appears in the above-identified patent and that said Letters Patent is hereby corrected as shown below:

Column 21,
Line 4, "constitute" should read -- constitutes --.
Line 49, "claim 18" should read -- claim 18, --.

Column 22,
Line 34, "the outer" should read -- at least a portion of the outer -- .

Signed and Sealed this

Twenty-third Day of October, 2001

*Attest:*

Nicholas P. Godici

NICHOLAS P. GODICI
*Acting Director of the United States Patent and Trademark Office*

*Attesting Officer*